US010197929B2

(12) United States Patent
Yumita et al.

(10) Patent No.: US 10,197,929 B2
(45) **Date of Patent: *Feb. 5, 2019**

(54) PHOTOCONDUCTOR AND METHOD FOR PRODUCING THE SAME

(71) Applicant: Konica Minolta, Inc., Tokyo (JP)

(72) Inventors: Masanori Yumita, Tokyo (JP); Toyoko Shibata, Kanagawa (JP); Tomoko Sakimura, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/832,992

(22) Filed: Dec. 6, 2017

(65) Prior Publication Data

US 2018/0164706 A1 Jun. 14, 2018

(30) Foreign Application Priority Data

Dec. 9, 2016 (JP) ..... 2016-239402

(51) Int. Cl.

| | |
|---|---|
| ***G03G 5/05*** | (2006.01) |
| ***G03G 5/06*** | (2006.01) |
| ***G03G 5/07*** | (2006.01) |
| ***G03G 5/00*** | (2006.01) |
| ***G03G 5/147*** | (2006.01) |

(52) U.S. Cl.

CPC ..... *G03G 5/0546* (2013.01); *G03G 5/00* (2013.01); *G03G 5/05* (2013.01); *G03G 5/0525* (2013.01); *G03G 5/0589* (2013.01); *G03G 5/0592* (2013.01); *G03G 5/06* (2013.01);

(Continued)

(58) Field of Classification Search

CPC ..... G03G 5/05; G03G 5/0546; G03G 5/0589; G03G 5/0525; G03G 5/0592; G03G 5/06; G03G 5/0648; G03G 5/07; G03G 5/071

See application file for complete search history.

(56) References Cited

U.S. PATENT DOCUMENTS 4,996,125 A * 2/1991 Sakaguchi ..... G03G 5/005 430/66
5,834,564 A * 11/1998 Nguyen ..... C08F 216/1416 525/326.3

(Continued)

FOREIGN PATENT DOCUMENTS

| | | |
|---|---|---|
| JP | 2012128324 A | 7/2012 |
| JP | 2015028613 A | 2/2015 |
| JP | 2015078620 A | 4/2015 |

*Primary Examiner* — Hoa V Le
(74) *Attorney, Agent, or Firm* — Lucas & Mercanti, LLP

(57) ABSTRACT

The photoconductor includes a conductive support, a photosensitive layer, and a protective layer. The protective layer is a polymer of a radical-polymerizable composition containing a perfluoropolyether compound including a radical-polymerizable functional group, a radical-polymerizable monomer including a radical-polymerizable functional group, and an inorganic fine particle including a radical-polymerizable functional group. The radical-polymerizable functional group of the perfluoropolyether compound is different from the radical-polymerizable functional group of the radical-polymerizable monomer and identical to the radical-polymerizable functional group of the inorganic fine particle.

5 Claims, 8 Drawing Sheets

(52) U.S. Cl.
CPC ..... *G03G 5/0648* (2013.01); *G03G 5/07* (2013.01); *G03G 5/071* (2013.01); *G03G 5/147* (2013.01)

(56) References Cited

U.S. PATENT DOCUMENTS

| | | | | |
|---|---|---|---|---|
| 9,964,871 | B2 * | 5/2018 | Sakimura | G03G 5/047 |
| 2017/0219943 | A1 * | 8/2017 | Shibata | G03G 5/043 |

* cited by examiner

PHOTOCONDUCTOR AND METHOD FOR PRODUCING THE SAME

CROSS REFERENCE TO RELATED APPLICATIONS

Japanese Patent Application No. 2016-239402 filed on Dec. 9, 2016, including description, claims, drawings, and abstract the entire disclosure is incorporated herein by reference in its entirety.

BACKGROUND

Technological Field

The present invention relates to a photoconductor and a method for producing the same.

Description of Related Art

Toners with a small particle size have been recently used for electrophotographic image forming apparatuses from the viewpoint of higher resolution, higher image quality, and achievement of a lower environmental load through lower energy consumption. Toners with a small particle size exhibit strong adhesion to the surface of a photoconductor. Thus, use of a toner with a small particle size leads to degradation of the transfer efficiency of a photoconductor to result in a higher environmental load such as increase in the amount of waste toners and increase in the power consumption associating with increased transfer bias, and may cause image failure such as a blank. Reduction in the transfer efficiency is currently controlled by applying a lubricant containing a metal salt of a higher fatty acid such as a metal stearate or a metal laurate onto the surface of a photoconductor to lower the surface energy of the photoconductor.

However, such a method may suffer from the occurrence of image failure in association with uneven coating in the axis direction of a photoconductor. It is deemed effective as a method to resolve the image failure to decrease a particle size of a lubricant and feed the lubricant together with a toner. However, a toner containing a lubricant may lower the amount of charge of a photoconductor, and, for example, result in formation of a degraded latent image.

Addition of a fluorine-containing material such as a fluorine-containing fine particle or a fluorine-containing lubricant to the protective layer of a photoconductor is known to improve the transfer efficiency of a toner through lowering the surface energy of the surface of the photoconductor to enhance the releasability. If the quantity of a fluorine-containing material added is large, however, the surface hardness of the protective layer is lowered and the photoconductor may have lower scratch resistance and shorter life time.

Fluorine-containing materials have a tendency to move to the surface of a coating film, and tend to be present at a high concentration only in the surface of the protective layer and the vicinity of the surface. For this reason, if a photoconductor with a fluorine-containing material is used for an image forming apparatus, the surface of the photoconductor is scraped over time to lead to loss of the releasability, and as a result, the image forming apparatus requires correction and the like of transfer conditions, and more energy may be needed.

As a technique to enhance both the abrasion resistance and high releasability of a photoconductor, it is known to form a protective layer formed of a polymer of a radical-polymerizable composition containing urethane acrylate including a perfluoropolyether site, a trifunctional or higher-functional radical-polymerizable monomer, and a radical-polymerizable compound having a charge-transporting structure (e.g., Japanese Patent Application Laid-Open No. 2012-128324).

As a technique to maintain both the toner releasability and low friction of the surface even after printing a large number of sheets, it is known to form a protective layer containing perfluoropolyether, wherein the ratio of the number of fluorine atoms to the number of carbon atoms is 0.10 or higher and 0.40 or lower (e.g., Japanese Patent Application Laid-Open No. 2015-028613).

In addition, formation of a protective layer obtained by polymerizing and crosslinking a polymerizable compound and a surface-treated metal oxide is known as a technique to enhance the hardness and scratch resistance of the surface of a photoconductor to thereby enhance the durability of the photoconductor (e.g., Japanese Patent Application Laid-Open No. 2015-078620).

Even in the case of the protective layer containing a perfluoropolyether compound, however, the abrasion resistance may be insufficient when the content of the perfluoropolyether compound is high, and the cleanability may become insufficient after endurance of repeated use when the content of the perfluoropolyether compound is low. As mentioned above, the conventional photoconductors still have problems to be solved from the viewpoint of maintenance of the abrasion resistance, scratch resistance, and toner releasability over a long period of time.

SUMMARY

An object of the present invention is to provide a photoconductor capable of maintaining the abrasion resistance, scratch resistance, and transfer efficiency over a long period of time.

To achieve at least one of the abovementioned objects, there is provided a photoconductor reflecting one aspect of the present invention including a conductive support, a photosensitive layer disposed on the conductive support, and a protective layer disposed on the photosensitive layer, in which the protective layer is a polymer of a radical-polymerizable composition including a perfluoropolyether compound including a radical-polymerizable functional group, a radical-polymerizable monomer including a radical-polymerizable functional group, and an inorganic fine particle including a radical-polymerizable functional group, and the radical-polymerizable functional group of the perfluoropolyether compound is different from the radical-polymerizable functional group of the radical-polymerizable monomer and identical to the radical-polymerizable functional group of the inorganic fine particle.

To achieve at least one of the abovementioned objects, there is provided a method for producing a photoconductor reflecting one aspect of the present invention including a conductive support, a photosensitive layer disposed on the conductive support, and a protective layer disposed on the photosensitive layer, the method including: forming a coating film of a radical-polymerizable composition comprising a perfluoropolyether compound including a radical-polymerizable functional group, a radical-polymerizable monomer including a radical-polymerizable functional group, and an inorganic fine particle including a radical-polymerizable functional group on the photosensitive layer; and radical-polymerizing the radical-polymerizable functional groups in the coating film to form the protective layer on the photosensitive layer, in which the radical-polymerizable functional group of the perfluoropolyether compound is different from the radical-polymerizable functional group of the radical-polymerizable monomer and identical to the radical-polymerizable functional group of the inorganic fine particle.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1A:
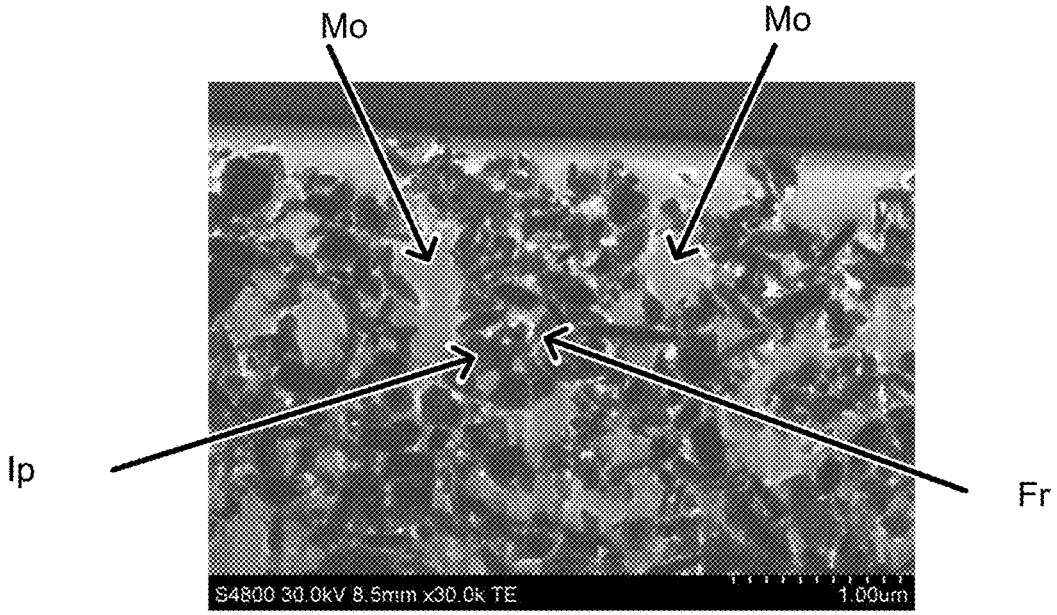
FIGS. 1A and 1B each show an SEM image of a cross-section of the protective layer of a photoconductor according to one embodiment of the present invention.

Hereinafter, one or more embodiments of the present invention will be described with reference to the drawings. However, the scope of the invention is not limited to the disclosed embodiments.

Now, one embodiment of the present invention will be described. The photoconductor is an image bearing member to bear a latent image or a visualized image on the surface in an electrophotographic image forming method.

[Configuration of Photoconductor]

The photoconductor includes a conductive support, a photosensitive layer disposed on the conductive support, and a protective layer disposed on the photosensitive layer. The photoconductor according to the present embodiment has the same configuration as conventional photoconductors except that the protective layer, which will be described later, is included therein, and can be produced in the same manner. Similarly, the protective layer has the same configuration as those of conventional photoconductors except that the protective layer has features described later, and can be prepared in the same manner. For example, the photoconductor can be configured in the same manner as a photoconductor described in Japanese Patent Application Laid-Open No. 2012-078620 except for its protective layer.

The conductive support is a member capable of supporting the photosensitive layer and having conductivity. Examples of the conductive support include drums or sheets of metal; plastic films including a metal foil laminated thereon; plastic films including a film of a conductive substance deposited thereon; and metal members, plastic films, or paper sheets including a conductive layer obtained by applying a conductive substance or a coating material consisting of a conductive substance and a binder resin. Examples of the metal include aluminum, copper, chromium, nickel, zinc, and stainless steel, and examples of the conductive substance include metals, indium oxide, and tin oxide.

The photosensitive layer is a layer to form an electrostatic latent image of an intended image on the surface of the photoconductor by light exposure as described later. The photosensitive layer may be configured with a single layer or a plurality of layers laminated. Examples of the photosensitive layer include a single layer containing a charge transport compound and a charge generation compound; and a laminate of a charge transport layer containing a charge transport compound and a charge generation layer containing a charge generation compound.

The protective layer is a layer disposed on the photosensitive layer and constituting the surface of the photoconductor, and, for example, is a layer to protect the photosensitive layer. The thickness of the protective layer can be appropriately determined in accordance with the type of the photoconductor, and is preferably 0.2 to 15 μm, and more preferably 0.5 to 10 μm.

The photoconductor may include any additional component which does not interfere with the advantageous effects of the present embodiment, in addition to the conductive support and the photosensitive layer. Examples of the additional component include an intermediate layer. The intermediate layer is a layer disposed, for example, between the conductive support and the photosensitive layer and having barrier function and adhering function.

The protective layer is a polymer of a radical-polymerizable composition containing a perfluoropolyether compound including a radical-polymerizable functional group, a radical-polymerizable monomer including a radical-polymerizable functional group, and an inorganic fine particle including a radical-polymerizable functional group.

In the description hereinafter, the perfluoropolyether compound including a radical-polymerizable functional group is also referred to as "radical-polymerizable PFPE", and the radical-polymerizable functional group of the perfluoropolyether compound is also referred to as "first radical-polymerizable functional group". The radical-polymerizable functional group of the radical-polymerizable monomer is also referred to as "second radical-polymerizable functional group". In addition, the inorganic fine particle including a radical-polymerizable functional group is also referred to as "radical-polymerizable inorganic fine particle", and the radical-polymerizable functional group of the inorganic fine particle is also referred to as "third radical-polymerizable functional group".

In the case that the radical-polymerizable functional groups are identical, radical polymerization takes place between them. In the present embodiment, the radical-polymerizable PFPE and the radical-polymerizable inorganic fine particle undergo radical polymerization and are assembled together in a manner such that the radical-polymerizable PFPE surrounds the radical-polymerizable inorganic fine particle.

The first radical-polymerizable functional group and the second radical-polymerizable functional group are different, and the first radical-polymerizable functional group and the third radical-polymerizable functional group are identical. Whether two groups are "different" or "identical" is determined by whether or not the two groups are completely coincident with each other. For example, an acryloyl group and a methacryloyl group, which are described later, are determined to be "different". For example, an acryloyl group and an acryloyl group, and a methacryloyl group and a methacryloyl group, which are described later, are each determined to be "identical".

The radical-polymerizable PFPE is an oligomer or polymer including perfluoroalkylene ether as a repeating unit. Examples of the structure of the repeating unit of perfluoroalkylene ether include the structure of a repeating unit of perfluoromethylene ether, the structure of a repeating unit of perfluoroethylene ether, and the structure of a repeating unit of perfluoropropylene ether. Among them, it is preferred for the perfluoropolyether to include repeating structural unit 1 represented by formula (a) or repeating structural unit 2 represented by formula (b).

[Chemical Formula 1]

(a)

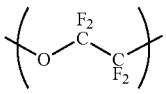

(b)

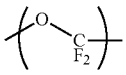

The radical-polymerizable PFPE to be used in the present invention is a compound including the perfluoropolyether structure represented by formula (C).

[Chemical Formula 2]

(C)

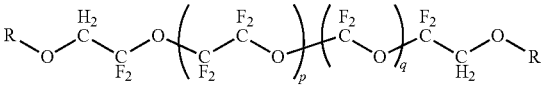

In the case that the radical-polymerizable PFPE includes repeating structural unit 1 or repeating structural unit 2, the number of repetitions of repeating structural unit 1, p, and the number of repetitions of repeating structural unit 2, q, are, for example, each an integer of 0 or more, and satisfy $p+q \geq 1$. p is preferably 2 to 20, and more preferably 4 to 15. q is preferably 2 to 20, and more preferably 4 to 15.

In the case that the radical-polymerizable PFPE includes both repeating structural unit 1 and repeating structural unit 2, repeating structural unit 1 and repeating structural unit 2 may be forming a block copolymer structure or be forming a random copolymer structure.

The weight average molecular weight, Mw, of the radical-polymerizable PFPE is preferably 100 or higher and 8,000 or lower, and more preferably 500 or higher and 5,000 or lower. Mw can be determined in accordance with a known method, for example, with use of gel permeation chromatography (GPC).

Each of the radical-polymerizable functional groups is a radical-polymerizable group, for example, having a carbon-carbon double bond. Each of the radical-polymerizable functional groups is preferably an acryloyl group or a methacryloyl group.

In the case that the radical-polymerizable PFPE includes two or more of the first radical-polymerizable functional group, the first radical-polymerizable functional groups may be included in R at one end in formula (C), or be included in R at each end. The number of the first radical-polymerizable functional groups is preferably two or more, more preferably four or more, and even more preferably six or more. It is particularly preferred for the radical-polymerizable PFPE to include four or more of the first radical-polymerizable functional group because the number of reaction points between the radical-polymerizable monomer and the radical-polymerizable inorganic fine particle is larger, and even higher abrasion resistance is imparted to the protective layer. It is preferred for the radical-polymerizable PFPE to have a symmetric molecular structure from the viewpoint of simpler synthesis of the radical-polymerizable PFPE. From this viewpoint, the number of the first radical-polymerizable functional groups is preferably an even number.

A commercially available product may be purchased or synthesis may be appropriately performed for the radical-polymerizable PFPE in which the first radical-polymerizable functional group is an acryloyl group or a methacryloyl group. Examples of commercially available products of the radical-polymerizable PFPE include Fluorolink (R) series AD1700, MD500, MD700, MT70, 5101X, and 5113X (Solvay Solexis, Inc.), OPTOOL DAC (DAIKIN INDUSTRIES, LTD.), and KY-1203 (Shin-Etsu Chemical Co., Ltd.).

In the case that the radical-polymerizable PFPE is synthesized, PFPE including a hydroxyl group or carboxyl group at the end can be used for the raw material. Examples of PFPE including a hydroxyl group at the end include Fomblin (R) D2, Fluorolink D4000, Fluorolink series E10H, 5158X, and 5147X, and Fomblin Ztetraol (Solvay Specialty Polymers); and Demnum-SA (DAIKIN INDUSTRIES, LTD.). Examples of PFPE including a carboxyl group at the end include Fomblin ZDIZAC4000 (Solvay Specialty Polymers) and Demnum-SH (DAIKIN INDUSTRIES, LTD.).

Examples of such radical-polymerizable PFPE include compounds P-1 to P-9.

[Chemical Formula 3]

P-1

$$XOCH_2—CF_2O(CF_2CF_2O)_m(CF_2O)_nCF_2—CH_2OX$$

P-2

$$XO(CH_2CH_2O)_nCH_2—CF_2O(CF_2CF_2O)_m(CF_2O)_nCF_2—CH_2(OCH_2CH_2)_pOX$$

-continued

P-3

$$(XOCH_2)_2CHO_2C—CF_2O(CF_2CF_2O)_m(CF_2O)_nCF_2—CO_2CH(CH_2OX)_2$$

P-4

$$(XOCH_2)_3CCH_2O_2C—CF_2O(CF_2CF_2O)_m(CF_2O)_nCF_2—CO_2CH_2C(CH_2OX)_3$$

P-5

$$XOCH_2\underset{\underset{OX}{|}}{CH}CH_2OCH_2—CF_2O(CF_2CF_2O)_m(CF_2O)_nCF_2—CH_2OCH_2\underset{\underset{OX}{|}}{CH}CH_2OX$$

P-6

$$XOCH_2CH_2NHCOOCH_2\underset{\underset{COONHCH_2CH_2OX}{|}}{CH}CH_2OCH_2—CF_2O(CF_2CF_2O)_m(CF_2O)_nCF_2—CH_2OCH_2\underset{\underset{OCONHCH_2CH_2OX}{|}}{CH}CH_2OCONHCH_2CH_2OX$$

P-7

$$(XOCH_2)_2(CH_3)CNHCOOCH_2—CF_2O(CF_2CF_2O)_m(CF_2O)_nCF_2—CH_2OCONHC(CH_3)(CH_2OX)_2$$

P-8

$$CF_3CF_2CF_2CF_2O(CF_2CF_2CF_2O)_nCF_2CF_2—CH_2OCONHC(CH_3)(CH_2OX)_2$$

P-9

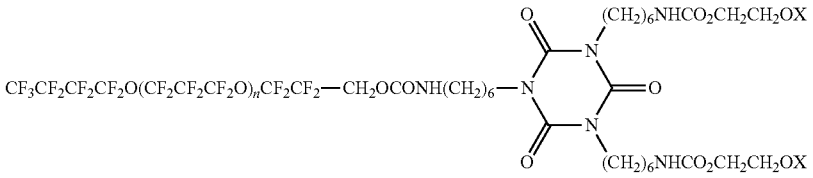

In compounds P-1 to P-9, X represents an acryloyl group or a methacryloyl group. Each "p" in compound P-2 independently denotes 1 to 10. Each "m" in compounds P-1 to P-9 is the same as p in repeating structural unit 1. In other words, m is an integer of 0 or more. Each "n" in compounds P-1 to P-9 is the same as q in repeating structural unit 2. In other words, n is an integer of 0 or more. Further, m and n satisfy $m+n \geq 1$.

For example, compound P-1 in which X is an acryloyl group is represented as "PFPEA1", and compound P-1 in which X is a methacryloyl group is represented as "PFPEM1".

The content of the radical-polymerizable PFPE in the radical-polymerizable composition is preferably 3 mass % or more and 100 mass % or less, more preferably 5 mass % or more and 80 mass % or less, and even more preferably 10 mass % or more and 50 mass % or less, with respect to the total solid content of the radical-polymerizable composition. If the content of the radical-polymerizable PFPE in the radical-polymerizable composition does not fall within the specified range, in particular, if the content is lower than the range, the image bearing member tends to have lower cleanability, and if the content is excessively high, in contrast, the abrasion resistance and scratch resistance may be insufficient.

The radical-polymerizable monomer is a compound which includes the second radical-polymerizable functional group and undergoes radical polymerization (curing) through addition of energy, for example, through irradiation with an active energy ray such as an ultraviolet ray, a visible ray, and an electron beam, or heating, to become a resin to be typically used as a binder resin for photoconductors. Examples of the radical-polymerizable monomer include styrenic monomers, acrylic monomers, methacrylic monomers, vinyl toluene-based monomers, vinyl acetate-based monomers, and N-vinylpyrrolidone-based monomers.

The second radical-polymerizable functional group is a radical-polymerizable group, for example, having a carbon-carbon double bond. The second radical-polymerizable functional group is particularly preferably an acryloyl group or a methacryloyl group because an acryloyl group or a methacryloyl group allows curing with a small amount of light or in a short period of time.

Examples of the radical-polymerizable monomer include compounds M1 to M15. In the formulas, R represents an acryloyl group, and R' represents a methacryloyl group.

[Chemical Formula 4]

M1

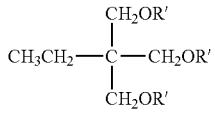

M2

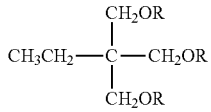

M3

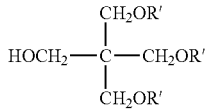

M4

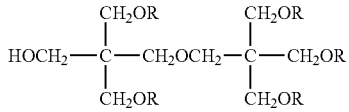

M5

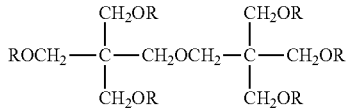

M6

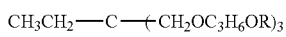

M7

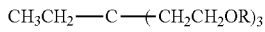

M8

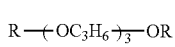

-continued

M9

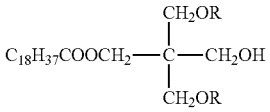

M10

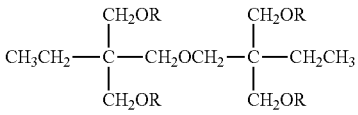

M11

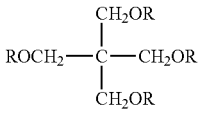

M12

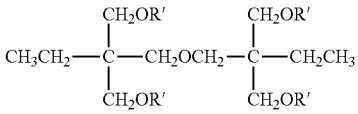

M13

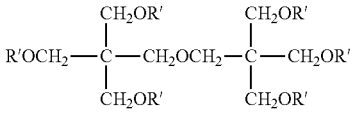

M14

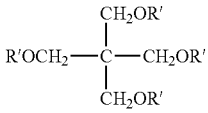

M15

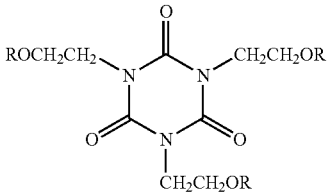

The radical-polymerizable monomer is known and available as a commercially available product. It is preferred for the radical-polymerizable monomer to be a compound including three or more of the second radical-polymerizable functional group, from the viewpoint of formation of the protective layer with high crosslinking density and accompanying high hardness imparted thereto.

The content of the radical-polymerizable monomer in the radical-polymerizable composition is preferably 5 mass % or more and 80 mass % or less, more preferably 10 mass % or more and 70 mass % or less, and even more preferably 20 mass % or more and 60 mass % or less, with respect to the total solid content of the radical-polymerizable composition. If the content of the radical-polymerizable monomer in the radical-polymerizable composition does not fall within the specified range, in particular, if the content is excessively low, the abrasion resistance and scratch resistance may be insufficient, and if the content is excessively high, in contrast, the image bearing member may have lower cleanability.

The radical-polymerizable inorganic fine particle includes the third radical-polymerizable functional group, and functions to enhance the hardness of the protective layer. The radical-polymerizable inorganic fine particle includes a metal oxide fine particle and an organic part including the third radical-polymerizable functional group, the organic part supported on the metal oxide fine particle and chemically bonding to the polymer. Supporting of the organic part including the third radical-polymerizable functional group on the surface of the metal oxide fine particle may be achieved through physical supporting or chemical bonding. One type or more types of the third radical-polymerizable functional group may be present, and the third radical-polymerizable functional groups may be identical or different.

The organic part includes the third radical-polymerizable functional group, and includes a surface treating agent residue chemically bonding to the surface of the metal oxide fine particle and chemically bonding to the polymer. In the protective layer, the metal oxide fine particle is present in a state such that the metal oxide fine particle is chemically bonding to the integrated polymer constituting the protective layer via the surface treating agent residue and the third radical-polymerizable functional group included in the surface of the metal oxide fine particle. Here, "surface treating agent residue" refers to, for example, a molecular structure which is a part derived from a surface treating agent and chemically bonding to the surface of the metal oxide fine particle and the polymer.

The content of the radical-polymerizable inorganic fine particle in the radical-polymerizable composition is preferably 30 parts by weight or more with respect to 100 parts by weight of the total of the radical-polymerizable PFPE and the radical-polymerizable monomer. The content of the radical-polymerizable inorganic fine particle in the radical-polymerizable composition falling within the specified range allows the protective layer to exert sufficient mechanical strength, and suitable electrical resistance is achieved. From the viewpoint of sufficient exertion of cleanability, the content of the radical-polymerizable inorganic fine particle in the radical-polymerizable composition is preferably 100 parts by weight or less with respect to 100 parts by weight of the total of the radical-polymerizable PFPE and the radical-polymerizable monomer.

If the content of the radical-polymerizable inorganic fine particle is less than 30 parts by weight, the protective layer may have insufficient abrasion resistance and scratch resistance. In addition, the protective layer may have a higher electric resistance to lead to increase in residual potential or frequent occurrence of fogging. If the content of the radical-polymerizable inorganic fine particle is more than 100 parts by weight, on the other hand, the releasability cannot be maintained because the fraction of the radical-polymerizable PFPE is smaller than that of the radical-polymerizable inorganic fine particle. In addition, the conductivity of the surface increases because of the configuration of the radical-polymerizable inorganic fine particle with a metal oxide, and hence the chargeability is lowered, which leads to frequent occurrence of image failure such as fogging, dust, and black spots.

The metal in the metal oxide fine particle may be a transition metal. The metal oxide fine particle may be one type or more types, and may be identical or different. Examples of the metal oxide in the metal oxide fine particle include silica (silicon oxide), magnesium oxide, zinc oxide, lead oxide, alumina (aluminum oxide), tin oxide, tantalum oxide, indium oxide, bismuth oxide, yttrium oxide, cobalt oxide, copper oxide, manganese oxide, selenium oxide, iron oxide, zirconium oxide, germanium oxide, tin oxide, titanium dioxide, niobium oxide, molybdenum oxide, vanadium oxide, and copper-aluminum composite oxide. Among them, the metal oxide is preferably alumina ($Al_2O_3$), tin oxide ($SnO_2$), titanium dioxide ($TiO_2$), or copper-aluminum composite oxide ($CuAlO_2$).

The number average primary particle size of the metal oxide fine particle is preferably 1 nm or larger and 300 nm or smaller, and particularly preferably 3 nm or larger and 100 nm or smaller. The number average primary particle size of the metal oxide fine particle may be a catalog value, or can be determined as follows: an enlarged photograph taken with a scanning electron microscope (manufactured by JEOL Ltd.) at a magnification of 10,000× is incorporated into a scanner, and images of 300 particles not including agglomerated particles in the photographic image obtained are randomly binarized by using the automatic image processing-analyzing system "LUZEX AP" (manufactured by NIRECO CORPORATION, "LUZEX" is a registered trademark possessed by the company, software Ver. 1.32) to calculate the Feret's diameter of each of the particle images in the horizontal direction; and the average value is calculated, which is used as the number average primary particle size. Here, "Feret's diameter in the horizontal direction" refers to the length of a side of a rectangle circumscribing the binarized particle image parallel to the x-axis of the rectangle.

The surface treating agent includes the third radical-polymerizable functional group and a surface-treating group. One type or more types of the surface treating agent may be used. The surface-treating group is a functional group having reactivity to a polar group such as a hydroxy group present on the surface of the metal oxide fine particle. The third radical-polymerizable functional group is a radical-polymerizable group, for example, having a carbon-carbon double bond, as with the case of that of the radical-polymerizable monomer or radical-polymerizable PFPE, and example thereof include a vinyl group, an acryloyl(oxy) group, and a methacryloyl(oxy) group. The third radical-polymerizable functional group is preferably identical to the first radical-polymerizable functional group.

The surface treating agent is preferably a silane coupling agent including the third radical-polymerizable functional group, and examples thereof include compounds S-1 to S-31.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2(OCH_3)$

Supporting of the organic part including the third radical-polymerizable functional group on the surface of the metal oxide fine particle can be achieved through a known surface treatment technique for metal oxide fine particles. For example, supporting of the organic part including the third radical-polymerizable functional group on the surface of the metal oxide fine particle can be achieved through the following method.

Treatment with 0.1 to 100 parts by weight of the surface treating agent and 50 to 5,000 parts by weight of a solvent with respect to 100 parts by weight of the metal oxide fine particle is performed by using a wet medium dispersion apparatus, and thus supporting of the organic part including the third radical-polymerizable functional group on the surface of the metal oxide fine particle can be achieved. Dry treatment is also applicable.

The metal oxide fine particle is miniaturized through wet pulverization of a slurry (suspension of solid particles) containing the metal oxide fine particle and the surface treating agent, and surface treatment of the fine particle then proceeds simultaneously. Thereafter, the solvent is removed to produce a powder, and thus the metal oxide fine particle homogeneously surface-treated with the surface treating agent can be obtained.

The above-mentioned wet medium dispersion apparatus as a surface treatment apparatus is an apparatus including a container filled with beads as a medium and a stirring disk attached perpendicularly to the rotational axis, and involving pulverizing/dispersing through crushing agglomerated particles of metal oxide by rotating the stirring disk at a high speed, and the configuration may be any one allowing sufficient dispersion and surface treatment of the metal oxide fine particle in surface treatment of the metal oxide fine particle, and various styles including vertical type and horizontal type, and a continuous mode and batch mode can be employed. Specifically, a sand mill, an Ultravisco mill, a pearl mill, a grain mill, a DYNO-MILL, an agitator mill, a DYNAMIC MILL, and so on, can be used. Each of these dispersion apparatuses uses a pulverizing medium such as balls and beads to perform fine pulverization and dispersion through impact crashing, friction, shear, shear stress, and so on.

A pulverizing medium made of, for example, glass, alumina, zircon, zirconia, steel, or flint can be used for beads to be used for the sand mill, and a medium made of zirconia and medium made of zircon are particularly preferred. With respect to the size of beads, beads with a diameter of about 1 to 2 mm are typically used, and use of beads with a diameter of about 0.1 to 1.0 mm is preferred in the present invention.

Various materials such as stainless steel, nylon, and ceramic can be used for the disk or the inner wall of the container for the wet medium dispersion apparatus, and it is particularly preferred in the present invention that the disk and the inner wall of the container be made of ceramic such as zirconia and silicon carbide.

Figure 1B:
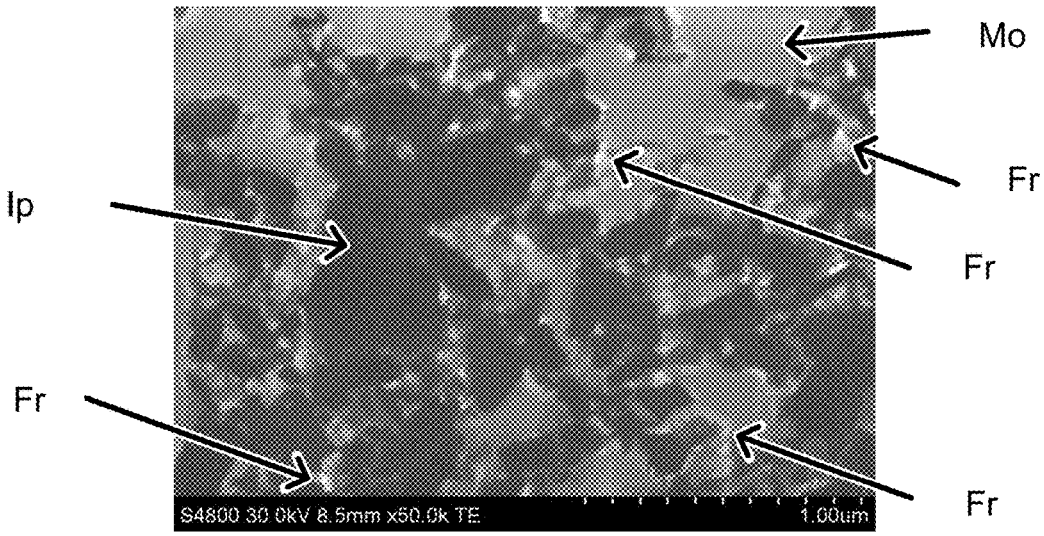
Figure 2A:
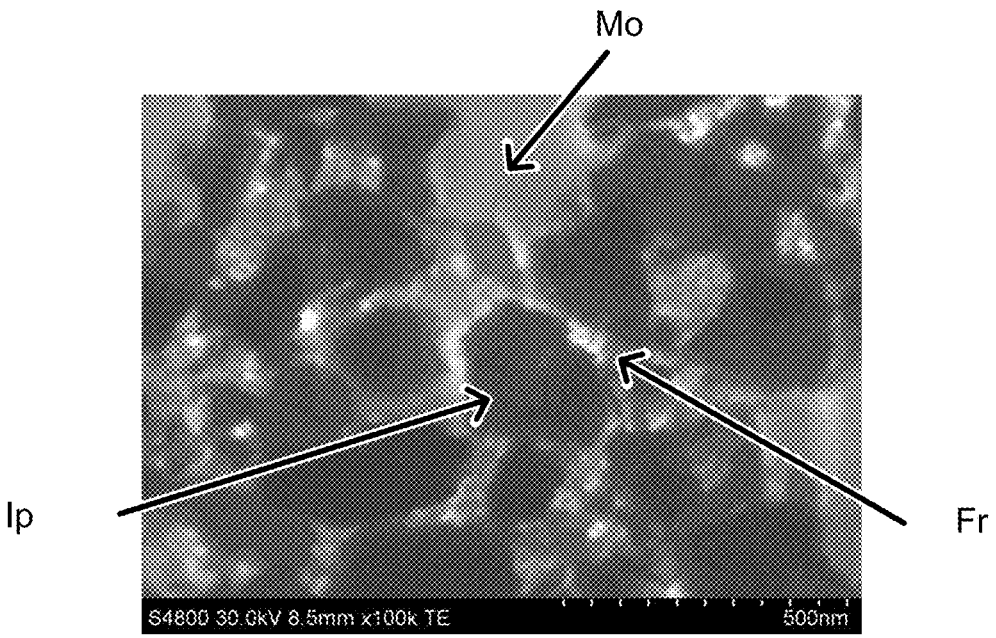
FIGS. 2A and 2B show an SEM image of a cross-section of the protective layer of a photoconductor of Example 10 and a schematic cross-sectional view of this protective layer, respectively.
Figure 2B:
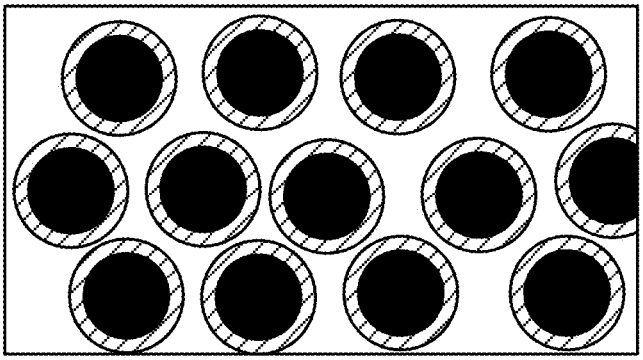
Figure 3A:
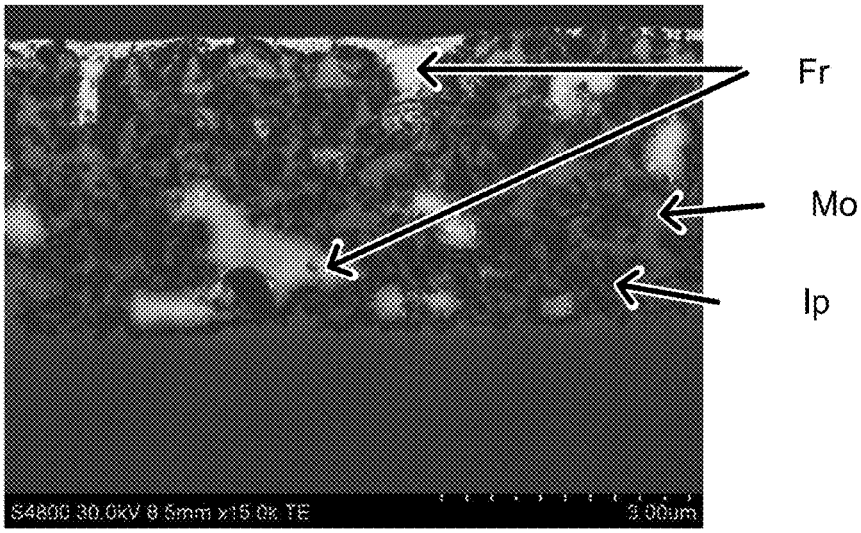
FIGS. 3A and 3B each show an SEM image of a cross-section of the protective layer of a photoconductor of Comparative Example 1.
Figure 3B:
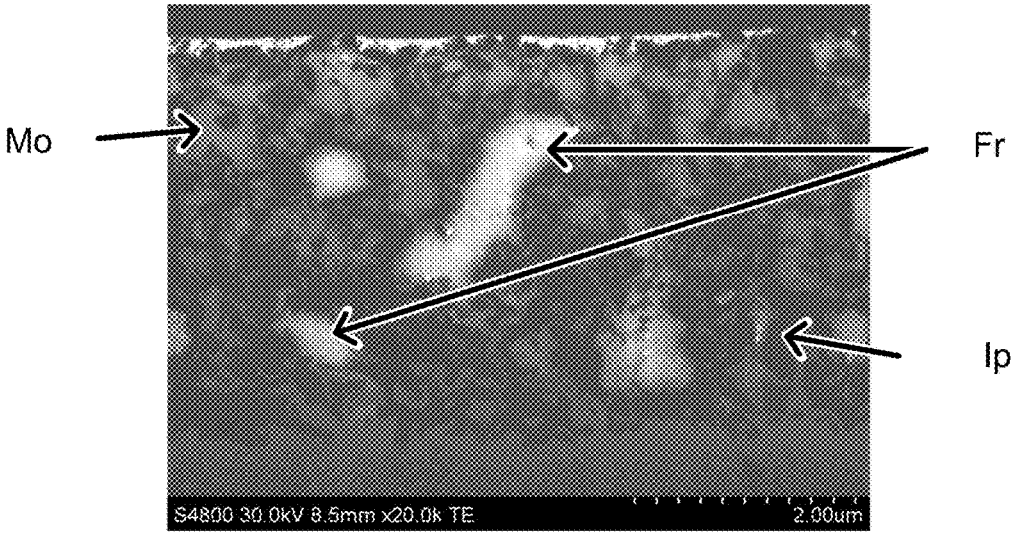
Figure 4A:
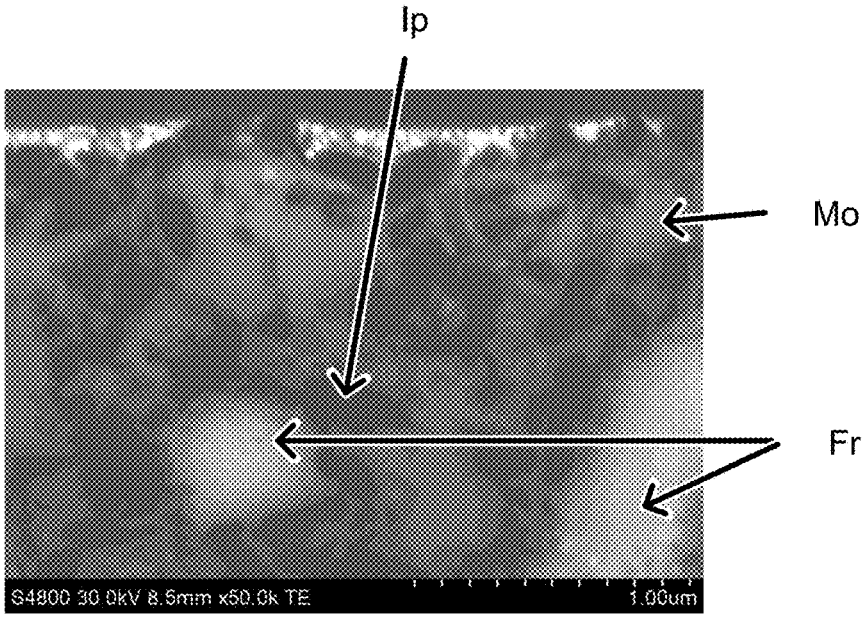
FIGS. 4A and 4B each show an SEM image of a cross-section of the protective layer of a photoconductor of Comparative Example 1.
Figure 4B:
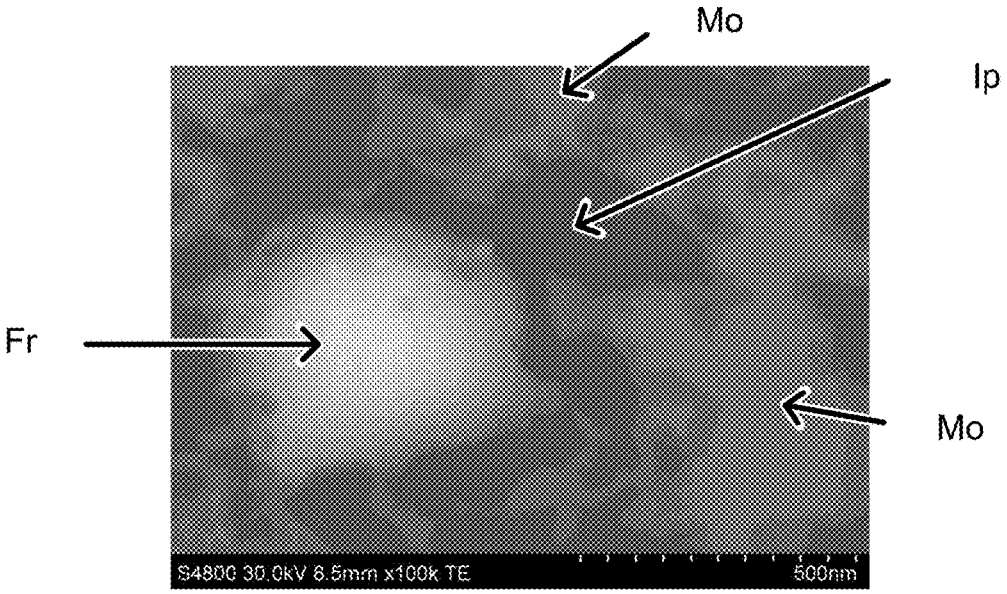
Figure 5:
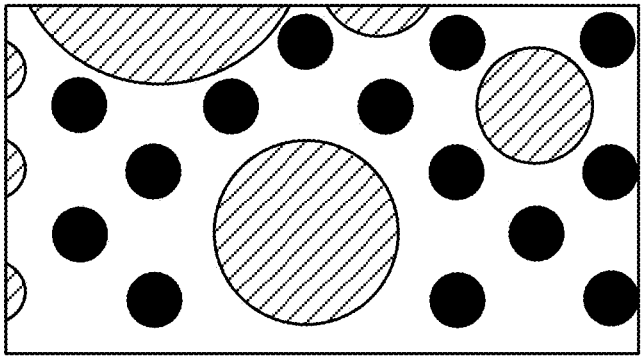
FIG. 5 is a schematic cross-sectional view of the protective layer of a photoconductor of Comparative Example 1.
Figure 6A:
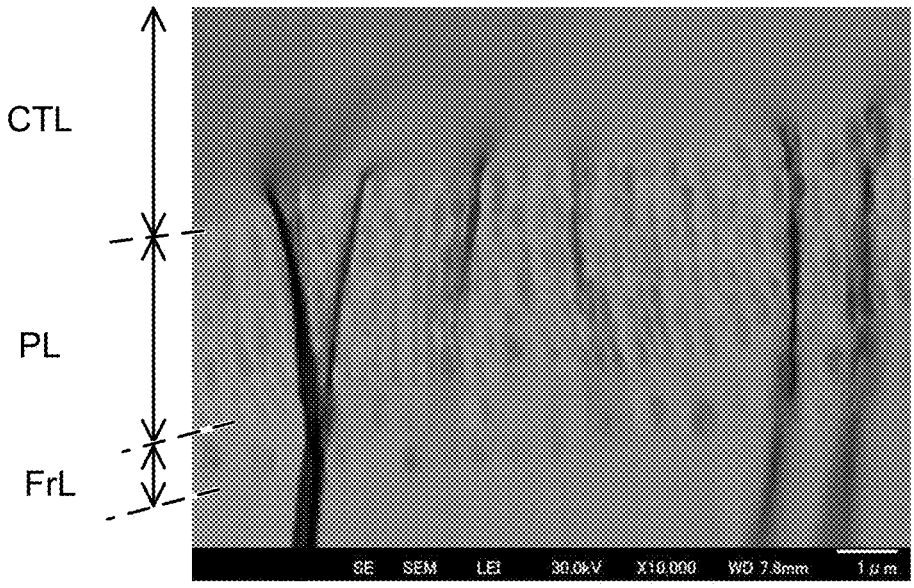
FIGS. 6A and 6B show an SEM image of a cross-section of the protective layer of a photoconductor of Comparative Example 8 and a schematic cross-sectional view of this protective layer, respectively.
Figure 6B:
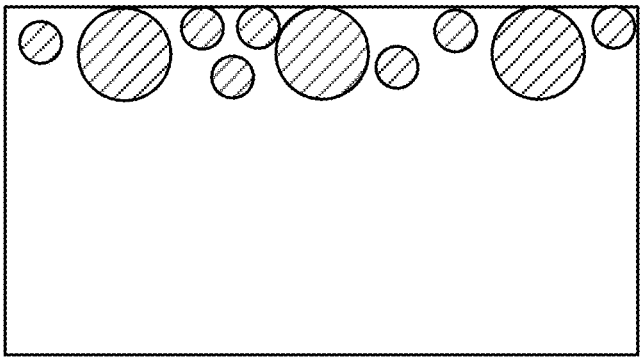

Next, the internal state of the protective layer will be described. FIGS. 1A, 1B, and 2A each show an SEM image of a cross-section of the protective layer of a photoconductor of Example 10 described later, and FIG. 2B is a schematic cross-sectional view of this protective layer. FIGS. 3A, 3B, 4A, and 4B each show an SEM image of a cross-section of the protective layer of a photoconductor of Comparative Example 1 described later, and FIG. 5 is a schematic cross-sectional view of this protective layer. FIG. 6A is an SEM image of a cross-section of the protective layer of a photoconductor of Comparative Example 8 described later, and FIG. 6B is a schematic cross-sectional view of this protective layer.

The magnifications of the SEM images of FIGS. 1A, 1B, 2A, 3A, 3B, 4A, and 4B are 30,000×, 50,000×, 100,000×, 15,000×, 20,000×, 50,000×, and 100,000×, respectively. Further, the magnification of the SEM image of FIG. 6A is 10,000×. In FIGS. 1A, 1B, 2A, 3A, 3B, 4A, and 5B, Mo indicates a site of a resin derived from the radical-polymerizable monomer, Ip indicates the inorganic fine particle, and Fr indicates a site of a resin derived from the radical-polymerizable PFPE. In FIGS. 6A and 6B, CTL indicates the charge transport layer, PL indicates the protective layer, and FrL indicates the PFPE layer.

As illustrated in FIGS. 1A, 1B, 2A, and 2B, in the protective layer in the case that the first radical-polymerizable functional group is different from the second radical-polymerizable functional group and the first radical-polymerizable functional group is identical to the third radical-polymerizable functional group, the radical-polymerizable PFPE is localized around the radical-polymerizable inorganic fine particle, and the radical-polymerizable PFPE can be more homogeneously dispersed in the protective layer. This is because radical polymerization more readily occurs between an identical type of the radical-polymerizable functional group than between different types of the radical-polymerizable functional group. Probably for this reason, high releasability can be maintained even over a long period of time, while the photoconductor is gradually abraded through repeated use.

Moreover, use of the radical-polymerizable PFPE including four or more of the first radical-polymerizable functional group leads to increase in the number of reaction points for the radical-polymerizable monomer and the radical-polymerizable inorganic fine particle. This allows the radical-polymerizable PFPE to be more homogeneously present in the protective layer, and hardness equivalent to or higher than those of conventional cured protective layers can be ensured even if a larger quantity of the radical-polymerizable PFPE is added, and thus excellent abrasion resistance and the scratch resistance are provided, and image failure such as uneven streaks caused by scratches in the surface of the photoconductor is prevented. The enhanced abrasion resistance leads to elongation of the life time of the photoconductor.

The radical-polymerizable functional groups possessed by the monomer, the PFPE, and the inorganic fine particle strongly bond together in the film to increase the film strength, and the radical-polymerizable inorganic fine particle and the radical-polymerizable PFPE can be homogeneously present. This is due to the agglomerative nature of the radical-polymerizable PFPE, and the first radical-polymerizable functional group possessed by the radical-polymerizable PFPE presumably allows the radical-polymerizable PFPE to remain around the radical-polymerizable functional groups of the radical-polymerizable monomer and the radical-polymerizable inorganic fine particle, and hence the homogeneous dispersion state in the film can be maintained even before being cured. These can be confirmed by using an analytical means such as SEM and ESCA. In Examples described later, the state in which the radical-polymerizable PFPE is localized around the radical-polymerizable inorganic fine particle and the radical-polymerizable PFPE is more homogeneously dispersed in the protective layer is represented as "state C".

As illustrated in FIGS. 3A, 3B, 4A, 4B, and 5, in the protective layer in the case that the first radical-polymerizable functional group, the second radical-polymerizable functional group, and the third radical-polymerizable functional group are identical, the radical-polymerizable PFPE and the radical-polymerizable inorganic fine particle are each independently present homogeneously as a sea-island structure. In Examples described later, the state in which the radical-polymerizable PFPE and the radical-polymerizable inorganic fine particle are each independently present is represented as "state B".

Further, as illustrate in FIGS. 6A and 6B, the radical PFPE has migrated to the surface side because of the nature of the PFPE to be surface-oriented in the case of the protective layer with no radical-polymerizable inorganic fine particle. In Examples described in later, the state in which the PFPE has migrated to the surface side is represented as "state A".

[Method for Producing Photoconductor]

The photoconductor can be produced by using a method including: forming a coating film of a radical-polymerizable composition containing a perfluoropolyether compound including a radical-polymerizable functional group, a radical-polymerizable monomer including a radical-polymerizable functional group, and an inorganic fine particle including a radical-polymerizable functional group above a photosensitive layer; and radical-polymerizing the radical-polymerizable functional groups in the coating film to form a protective layer on the photosensitive layer.

Examples of a solvent to be used in forming a coating film of a radical-polymerizable composition on a photosensitive layer include methanol, ethanol, n-propyl alcohol, isopropyl alcohol, n-butanol, t-butanol, sec-butanol, benzyl alcohol, toluene, xylene, methyl ethyl ketone, cyclohexane, ethyl acetate, butyl acetate, methyl cellosolve, ethyl cellosolve, tetrahydrofuran, 1,3-dioxane, 1,3-dioxolane, pyridine, and diethylamine. One solvent may be used singly, or two or more solvents may be used in combination.

In forming a protective layer on the photosensitive layer, the coating film of the radical-polymerizable composition is irradiated with an active energy ray such as an ultraviolet ray and an electron beam to cause radical polymerization to form a protective layer. To cause radical polymerization, curing reaction is elicited, for example, by using a method utilizing cleavage reaction caused by an electron beam or a method utilizing a radical polymerization initiator in the presence of light or heat.

In the case that curing reaction is elicited by using a radical polymerization initiator, any of photopolymerization initiators and thermal polymerization initiators can be used for the polymerization initiator. In addition, combination of a photopolymerization initiator and a thermal polymerization initiator can be used.

Examples of the polymerization initiator include thermal polymerization initiators including azo compounds such as 2,2'-azobisisobutyronitrile, 2,2'-azobis(2,4-dimethylazobisvaleronitrile), and 2,2'-azobis(2-methylbutyronitrile); and peroxides such as benzoyl peroxide (BPO), di-tert-butyl hydroperoxide, tert-butyl hydroperoxide, chlorobenzoyl peroxide, dichlorobenzoyl peroxide, bromomethylbenzoyl peroxide, and lauroyl peroxide.

Examples of photopolymerization initiators include acetophenone-based or ketal-based photopolymerization initiators such as diethoxyacetophenone, 2,2-dimethoxy-1,2-diphenylethan-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl) butanone-1 (IRGACURE 369: BASF Japan Ltd.), 2-hydroxy-2-methyl-1-phenylpropan-1-one, 2-methyl-2-morpholino(4-methylthiophenyepropan-1-one, and 1-phenyl-1,2-propanedione-2-(o-ethoxycarbonyl)oxime; benzoin ether-based photopolymerization initiators such as benzoin, benzoin methyl ether, benzoin ethyl ether, benzoin isobutyl ether, and benzoin isopropyl ether; benzophenone-based photopolymerization initiators such as benzophenone, 4-hydroxybenzophenone, methyl o-benzoylbenzoate, 2-benzoylnaphthalene, 4-benzoylbiphenyl, 4-benzoyl phenyl ether, acrylated benzophenone, and 1,4-benzoylbenzene; and thioxanthone-based photopolymerization initiators such as 2-isopropylthioxanthone, 2-chlorothioxanthone, 2,4-dimethylthioxanthone, 2,4-diethylthioxanthone, and 2,4-dichlorothioxanthone.

Other examples of photopolymerization initiators include ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methyl phenylglyoxylate, 9,10-phenanthrene, acridine-based compounds, triazine-based compounds, and imidazole-based compounds. In addition, a substance having photopolymerization-promoting effect can be used singly or in combination with a photopolymerization initiator. Examples of substances having photopolymerization-promoting effect include triethanolamine, methyldiethanolamine, ethyl 4-dimethylaminobenzoate, isoamyl 4-dimethylaminobenzoate, (2-dimethylamino)ethyl benzoate, and 4,4'-dimethylaminobenzophenone.

As the polymerization initiator to be used in the present invention, the photopolymerization initiator is preferred, alkylphenone-based compounds and phosphine oxide-based compounds are preferred, and initiators having α-hydroxyacetophenone structure and initiators having acylphosphine oxide structure are more preferred.

One of these polymerization initiators may be used singly, or two or more thereof may be used in a mixture. The content of the radical polymerization initiator in the radical-polymerizable composition is preferably 0.1 parts by weight or more and 40 parts by weight or less, and more preferably 0.5 parts by weight or more and 20 parts by weight or less, with respect to 100 parts by weight of the radical-polymerizable components (e.g., the total quantity of the radical-polymerizable PFPE, the radical-polymerizable monomer, and the radical-polymerizable inorganic fine particle).

The photoconductor can be produced in accordance with a known method for producing a photoconductor, except that the above-described radical-polymerizable composition is used. For example, the photoconductor can be produced by using a method including: applying a coating solution for a protective layer, the solution containing the radical-polymerizable composition, onto the surface of a photosensitive layer formed on a conductive support; and radical-polymerizing the radical-polymerizable functional groups in the coating solution for a protective layer through irradiating the applied coating solution for a protective layer with an active energy ray or heating the applied coating solution for a protective layer.

Analysis of the polymer by using a known instrumental analysis technique such as pyrolysis-GC-MS, nuclear magnetic resonance (NMR), a Fourier transform infrared spectrometer (FT-IR), and elemental analysis can confirm that the polymer is a polymer of the radical-polymerizable compounds.

[Configuration of Image Forming Apparatus]

The above-described photoconductor is, for example, incorporated for use in an electrophotographic image forming apparatus. For example, an image forming apparatus includes: a photoconductor; a charging unit to charge the surface of the photoconductor; a light exposing unit to irradiate the charged surface of the photoconductor with light to form an electrostatic latent image; a developing unit to feed a toner to the photoconductor bearing the electrostatic latent image formed thereon to form a toner image; a transferring unit to transfer the toner image on the surface of the photoconductor to a recording medium; a lubricant-feeding unit to feed a lubricant to the surface of the photoconductor; and a cleaning unit to remove the toner remaining on the surface of the photoconductor.

The photoconductor is applied to an image forming method in which a toner is fed to the surface of the photoconductor bearing an electrostatic latent image formed thereon to form a toner image corresponding to the electrostatic latent image on the surface of the photoconductor, the toner image is transferred from the surface of the photoconductor to a recording medium, and the toner remaining on the surface of the photoconductor is removed by a cleaning device. This image forming method is performed, for example, by using the above image forming apparatus.

Figure 7:
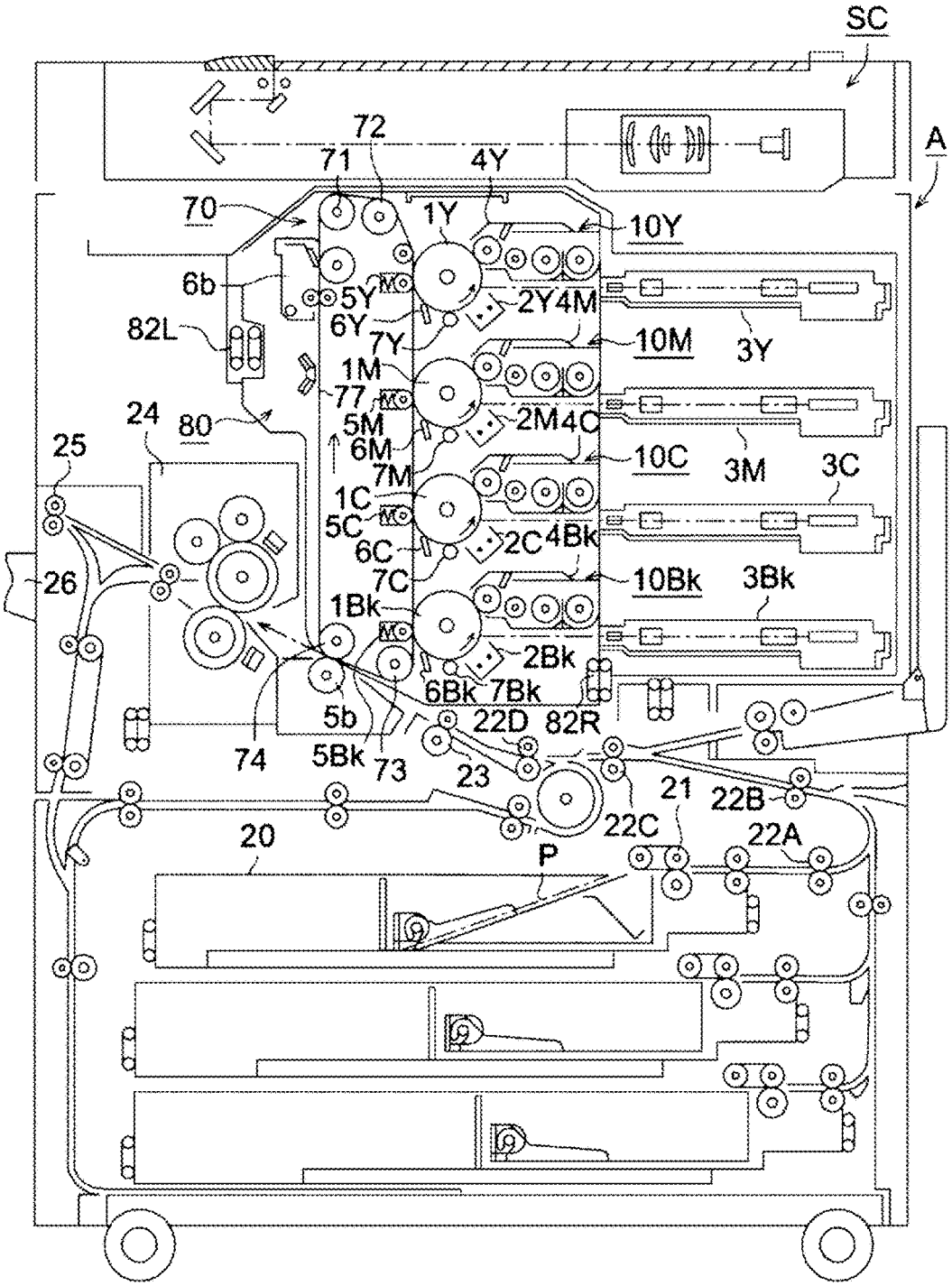
FIG. 7 is a diagram schematically illustrating one example of the configuration of an image forming apparatus for which the photoconductor according to one embodiment of the present invention is used.
Figure 8A:
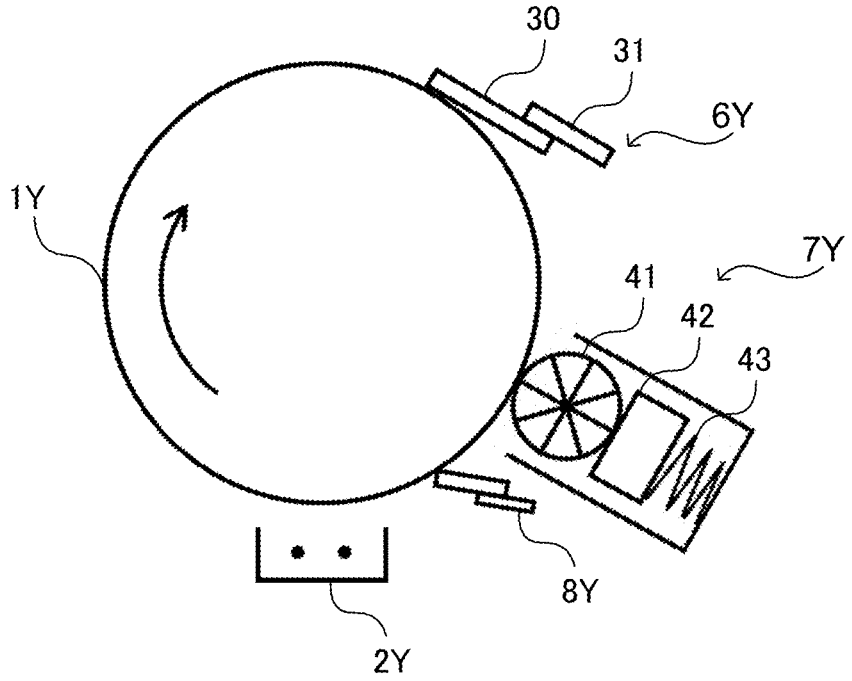
FIGS. 8A and 8B show a diagram schematically illustrating one example of the configuration of an image forming unit including a lubricant-feeding unit and a diagram schematically illustrating one example of the configuration of an image forming unit including no lubricant-feeding unit, respectively.

FIG. 7 is a diagram schematically illustrating one example of the configuration of an image forming apparatus including the photoconductor. FIG. 8A is a diagram schematically illustrating one example of the configuration of an image forming unit including a lubricant-feeding unit. As illustrated in FIG. 7, the image forming apparatus is a tandem color image forming apparatus. The image forming apparatus consists of four image-forming sections (image forming units) 10Y, 10M, 10C, and 10Bk; intermediate transfer member unit 70; sheet-feeding unit 21; and fixing unit 24. On main body A of the image forming apparatus, original image reader SC is disposed.

Four image forming units 10Y, 10M, 10C, and 10Bk are respectively configured with photoconductors 1Y, 1M, 1C, and 1Bk, which are positioned at the respective centers of image forming units 10Y, 10M, 10C, and 10Bk; charging units (charging devices) 2Y, 2M, 2C, and 2Bk; light exposing units (exposing devices) 3Y, 3M, 3C, and 3Bk; developing units (developing devices) 4Y, 4M, 4C, and 4Bk each being rotatable; primary transfer rollers 5Y, 5M, 5C, and 5Bk each as a primary transferring unit; lubricant-feeding units (lubricant-feeding devices) 7Y, 7M, 7C, and 7Bk; and cleaning units (cleaning devices) 6Y, 6M, 6C, and 6Bk to clean photoconductors 1Y, 1M, 1C, and 1Bk, respectively. The image forming apparatus uses the photoconductor according to the present invention for each of photoconductors 1Y, 1M, 1C, and 1Bk.

Image forming units 10Y, 10M, 10C, and 10Bk have identical configuration with only difference that the colors for a toner image to be formed on photoconductors 1Y, 1M, 1C, and 1Bk are yellow, magenta, cyan, and black, respectively. In the following description, image forming unit 10Y is primarily used as an example for description.

Image forming unit 10Y, in which charging unit 2Y, light exposing unit 3Y, developing unit 4Y, and cleaning unit 6Y are disposed around photoconductor 1Y as a member to form an image thereon, forms a yellow (Y) toner image on photoconductor 1Y.

Charging unit 2Y is a unit to negatively charge the surface of photoconductor 1Y uniformly. For example, a corona charger is used for charging unit 2Y.

Light exposing unit 3Y is a unit to form an electrostatic latent image corresponding to the yellow image on the surface of photoconductor 1Y to which a uniform potential has been applied by charging unit 2Y through light exposure of the surface of photoconductor 1Y on the basis of image signals (yellow). For light exposing unit 3Y, for example, a light exposing unit configured with an LED including an array of light-emitting elements arranged in the axis direction of photoconductor 1Y and an imaging element, or a laser optical system is used.

Developing unit 4Y includes, for example, a developing sleeve incorporating a magnet therein to rotate with holding a developer, and a voltage-applying device to apply a direct and/or alternating bias voltage between the photoconductor and the developing sleeve.

Lubricant-feeding unit 7Y is a unit to feed a lubricant to the surface of photoconductor 1Y. The lubricant fed to the surface of photoconductor 1Y by lubricant-feeding unit 7Y forms a lubricant skin film. As illustrated in FIG. 8A, lubricant-feeding unit 7Y is disposed in the downstream of cleaning unit 6Y and in the upstream of charging unit 2Y along the rotation direction of photoconductor 1Y. It should be noted that the position of lubricant-feeding unit 7Y is not limited to the position in the downstream of cleaning unit 6Y and in the upstream of charging unit 2Y.

Lubricant-feeding unit 7Y includes, for example, a solid lubricant and a lubricant-applying member such as a brush roller. Specifically, lubricant-feeding unit 7Y includes: lubricant stock 42 configured with a rectangular solid lubricant; brush roller 41 in contact with the surface of photoconductor 1Y to apply the lubricant scraped by rubbing the surface of lubricant stock 42 onto the surface of photoconductor 1Y; pressurizing spring 43 to press lubricant stock 42 onto brush roller 41; and a driving system (not illustrated) to rotationally drive brush roller 41. The tips of the brush of brush roller 41 are in contact with the surface of photoconductor 1Y. Brush roller 41 is rotationally driven in the same rotation direction as photoconductor 1Y at a constant speed.

For example, a brush roller obtained in a manner such that a ribbon of a pile fabric cloth in which pile threads as bundles of fibers are woven in a base cloth is spirally wound around a metal shaft with the brushed side facing outward and adhered together can be used for brush roller 41. The cylindrical peripheral surface of the main body of brush roller 41 is formed of, for example, a long woven fabric including brush fibers of resin such as polypropylene densely planted thereon.

The brush hairs are preferably straight brush hairs, which stand in the direction perpendicular to the metal shaft, from the viewpoint of application ability. The threads used for the brush hairs are preferably filament threads. Examples of materials of filament threads include synthetic resins such as 6-nylon, 12-nylon, polyesters, acrylic resins, and vinylon. Other examples of materials of filament threads include threads including carbon or metal such as nickel kneaded therein, from the viewpoint of enhancement of the conductivity. It is preferred that the thickness of the brush fiber be, for example, 3 to 7 denier, the hair length of the brush fiber be, for example 2 to 5 mm, the electrical resistivity of the brush fiber be, for example, $1\times10^{10}\Omega$ or lower, the Young's modulus of the brush fiber be, for example, 4,900 to 9,800 $N/mm^2$, and the planting density of the brush fiber (the number of the brush fibers per unit area) be, for example, 50,000 to 200,000 (50 k to 200 k) fibers/$inch^2$. The depth of digging of brush roller 41 into photoconductor 1Y is preferably 0.5 to 1.5 mm. The rotation speed of brush roller 41 is, for example, 0.3 to 1.5 as a rotation speed ratio to the rotation speed of photoconductor 1Y. The rotation direction of brush roller 41 may be the same as the rotation direction of photoconductor 1Y or the reverse direction to the rotation direction of photoconductor 1Y.

Pressurizing spring 43 used is a pressurizing spring to press lubricant stock 42 in the direction such that lubricant stock 42 approaches photoconductor 1Y so that the pressing force applied to photoconductor 1Y by brush roller 41 reaches, for example, 0.5 to 1.0 N.

Lubricant-feeding unit 7Y adjusts, for example, the pressing pressure applied to brush roller 41 by lubricant stock 42 and the rotation speed of brush roller 41 so that the amount of coating per $cm^2$ on the surface of photoconductor 1Y reaches $0.5\times10^{-7}$ to $1.5\times10^{-7}$ $g/cm^2$. In the image forming apparatus illustrated in FIG. 7, leveling blade 8Y to homogeneously apply the lubricant fed to the surface of photoconductor 1Y by lubricant-feeding unit 7Y is provided in the downstream of lubricant-feeding unit 7Y and in the upstream of charging unit 2Y.

Examples of the lubricant include metal salts of fatty acid such as zinc oleate, zinc stearate, and calcium stearate. The lubricant is preferably zinc stearate from the viewpoint of lubricity and spreadability.

Cleaning unit 6Y is a device to remove the toner remaining on the surface of photoconductor 1Y. Cleaning unit 6Y includes, for example, a cleaning blade. The cleaning blade includes supporting member 31 and blade member 30 supported on supporting member 31 via an adhesive layer (not illustrated). Blade member 30 is disposed in a manner such that the tip of blade member 30 is facing the opposite direction (counter direction) to the rotation direction of photoconductor 1Y at the portion in contact with the surface of photoconductor 1Y.

A known supporting member can be used for supporting member 31. Examples of supporting member 31 include supporting members produced from rigid metal, elastic metal, plastic, and ceramic. Supporting member 31 is preferably made of rigid metal.

Blade member 30 has, for example, a multilayer structure of a base layer and edge layer laminated. Each of the base layer and edge layer is preferably composed of polyurethane. Examples of the polyurethane include those obtained by reacting polyol, polyisocyanate, and, as necessary, a crosslinking agent.

Photoconductor 1Y, charging unit 2Y, developing unit 4Y, lubricant-feeding unit 7Y, and cleaning unit 6Y included in image forming unit 10Y are integrally supported, which is included as a process cartridge in the image forming apparatus. This process cartridge may be configured to be detachable and attachable to main body A of the apparatus via a guiding unit such as a rail.

Image forming units 10Y, 10M, 10C, and 10Bk are disposed in parallel in the vertical direction, and intermediate transfer member unit 70 is disposed in the left side of the illustration of photoconductors 1Y, 1M, 1C, and 1Bk. Intermediate transfer member unit 70 is rotated by a plurality of rollers 71, 72, 73, and 74, and includes intermediate transfer member 77 as a semiconductive endless belt rotatably supported, secondary transfer roller 5*b* as a secondary transferring unit, and cleaning unit 6*b*.

Image forming units 10Y, 10M, 10C, and 10Bk and intermediate transfer member unit 70 are housed in casing 80, and casing 80 is configured to be withdrawable from main body A of the apparatus via support rails 82L and 82R.

Fixing unit 24 is, for example, in a thermal roller fixing mode, and includes a heat roller including a heat source in the inside, and a pressure roller provided in a manner such that the pressure roller is in contact with and pressed to the heat roller so as to form a fixing nip.

Although the image forming apparatus is configured to feed a lubricant by a method of applying a solid lubricant with a brush roller in the above description, the method for feeding a lubricant is not limited thereto. A method may be employed in which a fine powder lubricant externally added to a toner is fed to a photoconductor by the action of a developing electric field formed in developing.

Figure 8B:
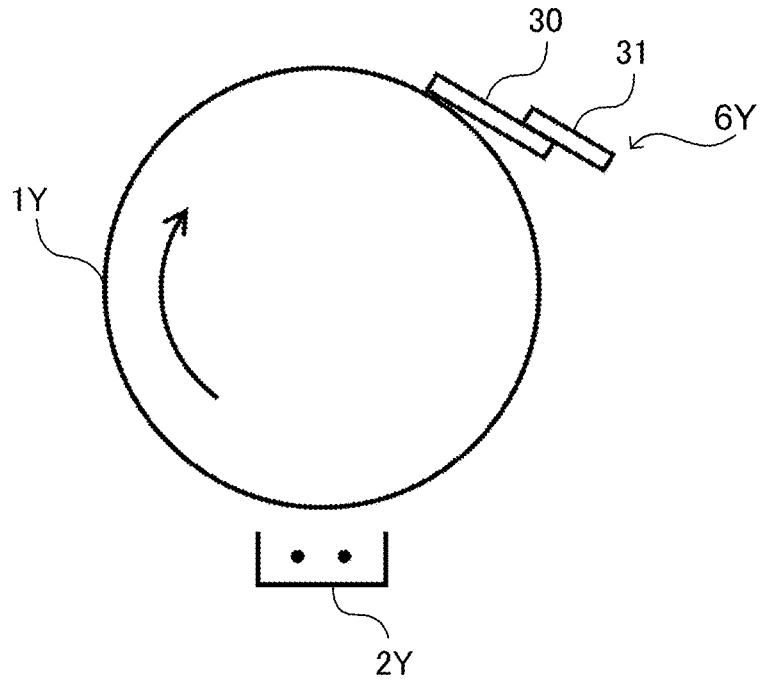

FIG. 8B is a diagram schematically illustrating one example of the configuration of an image forming unit including no lubricant-feeding unit. As illustrated in FIG. 8B, the image forming apparatus is not required to include a lubricant-feeding unit.

In this case, the number average primary particle size of the lubricant is, for example, preferably 0.5 to 20 μm. It is preferred to add the lubricant at a fraction of 0.01 to 0.3 mass % with respect to the mass of the toner so as not to affect the chargeability of the toner.

The fine powder lubricant to be externally added to the toner may be any fine powder lubricant having lubricity and cleavability without any limitation, and examples thereof include zinc stearate and calcium stearate.

Although the image forming apparatus is illustrated as a color laser printer in the above, the image forming apparatus may be configured as a monochrome laser printer or copier. A light source other than lasers such as an LED light source can be used as a light source for light exposure in the image forming apparatus according to the present invention.

Formation of an image with the image forming apparatus will be described.

First, the surfaces of photoconductors 1Y, 1M, 1C, and 1Bk are negatively charged by charging unit 2Y, 2M, 2C, and 2Bk, respectively, through discharging (charging). Subsequently, the surfaces of photoconductors 1Y, 1M, 1C, and 1Bk are exposed by light exposing units 3Y, 3M, 3C, and 3Bk, respectively, on the basis of the image signals to form electrostatic latent images (exposing). Then, developing units 4Y, 4M, 4C, and 4Bk provide toners on the surfaces of photoconductors 1Y, 1M, 1C, and 1Bk, respectively, for development to form toner images corresponding to the electrostatic latent images (developing). "Toner image" refers to an assemblage of toners as an image.

Subsequently, primary transfer rollers 5Y, 5M, 5C, and 5Bk are contacted with intermediate transfer member 77 rotating. Thereby, the toner images of respective colors formed on photoconductors 1Y, 1M, 1C, and 1Bk are sequentially transferred to intermediate transfer member 77 rotating to form a color toner image (primary transferring). During the image forming process, primary transfer roller 5Bk is constantly in contact with photoconductor 1Bk. On the other hand, primary transfer rollers 5Y, 5M, and 5C correspondingly come into contact with photoconductors 1Y, 1M, and 1C, respectively, only in formation of a color image.

After primary transfer rollers 5Y, 5M, 5C, and 5Bk and intermediate transfer member 77 are separated, then lubricant-feeding units 7Y, 7M, 7C, and 7Bk feed the lubricant to the surfaces of photoconductors 1Y, 1M, 1C, and 1Bk, respectively (lubricant feeding). Thereafter, cleaning units 6Y, 6M, 6C, and 6Bk remove the toners remaining on the surfaces of photoconductors 1Y, 1M, 1C, and 1Bk, respectively (cleaning). Then, the surface of each of photoconductors 1Y, 1M, 1C, and 1Bk is decharged by a decharging unit (not illustrated), as necessary, for the next image forming process.

In this way, the image forming apparatus is configured to feed the lubricant to the surfaces of photoconductors 1Y, 1M, 1C, and 1Bk every image forming process.

As described above, the protective layer of each of photoconductors 1Y, 1M, 1C, and 1Bk is a polymer of the radical-polymerizable PFPE, the radical-polymerizable monomer, and the radical-polymerizable inorganic fine particle. By virtue of this configuration, the PFPE portion of the radical-polymerizable PFPE is homogeneously dispersed in a sufficient amount over the whole of the protective layer. Thereby, abrasion resistance and scratch resistance resulting from the sufficient hardness of the polymer and high cleanability resulting from the PFPE portion are continuously exerted.

Meanwhile, recording medium P (e.g., a support to bear a final image, such as a sheet of normal paper and a transparent sheet) housed in sheet feeding cassette 20 is fed by sheet-feeding unit 21, and passes through a plurality of intermediate rollers 22A, 22B, 22C, and 22D, and registration roller 23, and is conveyed to secondary transfer roller 5*b* as a secondary transferring unit, and secondary transfer roller 5*b* is contacted with intermediate transfer member 77, and thereby a color toner image is transferred onto recording medium P at once. Recording medium P bearing the color toner image transferred is fixed by fixing unit 24, and conveyed to sheet tray 26 present out of the apparatus while being sandwiched by sheet ejection rollers 25, and placed thereon. Secondary transfer roller 5*b* is contacted with intermediate transfer member 77 only in secondary transferring.

After the color toner image is transferred onto recording medium P by secondary transfer roller 5*b*, cleaning unit 6*b* removes the remaining toner from intermediate transfer member 77 after self-stripping of recording medium P.

The toner to be used for the above-described image forming apparatus contains a toner particle containing binder resin and a colorant. The toner particle may contain an additional component such as a release agent, as desired.

Any of a pulverized toner and a polymerized toner can be used for the toner. A polymerized toner is preferably used for the toner from the viewpoint that an image of high quality can be obtained.

The average particle size of the toner is preferably 2 to 8 μm as a volume-based median diameter. This average particle size allows higher resolution.

To the toner particle, an inorganic fine particle such as silica and titania having an average particle size of about 10 to 300 nm or a polishing agent of about 0.2 to 3 μm as an external additive can be externally added in an appropriate quantity.

The toner can be used as a magnetic or nonmagnetic one-component developer, or alternatively may be mixed with a carrier for use as a two-component developer. In the case that the toner is used as a two-component developer, a magnetic particle made of a conventionally known material, for example, a ferromagnetic metal such as iron, an alloy of a ferromagnetic metal and aluminum, lead, or the like, or a compound of a ferromagnetic metal such as ferrite and magnetite can be used for the carrier, and ferrite is particularly preferred.

Hereinbefore, the embodiments of the present invention have been specifically described. However, embodiments of the present invention are not limited to the above exemplary ones in any way, and various modifications can be added.

As is clear from the above description, the photoconductor is a photoconductor including a conductive support, a photosensitive layer disposed on the conductive support, and a protective layer disposed on the photosensitive layer, wherein the protective layer is a polymer of a radical-polymerizable composition containing a perfluoropolyether compound including a radical-polymerizable functional group, a radical-polymerizable monomer including a radical-polymerizable functional group, and an inorganic fine particle including a radical-polymerizable functional group, and the radical-polymerizable functional group of the perfluoropolyether compound is different from the radical-polymerizable functional group of the radical-polymerizable monomer and identical to the radical-polymerizable functional group of the inorganic fine particle. By virtue of this configuration, the photoconductor is excellent in abrasion resistance, scratch resistance, and toner releasability, and generation of image defects due to cleaning failure can be prevented over a long period of time in an electrophotographic image forming method.

The configuration in which the number of the radical-polymerizable functional groups of the perfluoropolyether compound is four or more is even more effective from the viewpoint that such configuration leads to increase in the number of reaction points for the radical-polymerizable monomer and the radical-polymerizable inorganic fine particle, and even higher abrasion resistance is imparted to the protective layer.

The configuration in which each of the radical-polymerizable functional groups is an acryloyl group or a methacryloyl group is even more effective from the viewpoint of enhancement of the abrasion resistance and scratch resistance of the photoconductor.

The configuration in which the inorganic fine particle includes a metal oxide fine particle and an organic part including a radical-polymerizable functional group, the organic part supported on the metal oxide fine particle, is even more effective from the viewpoint of enhancement of the abrasion resistance and scratch resistance of the photoconductor.

The method for producing the photoconductor is a method for producing a photoconductor including a conductive support, a photosensitive layer disposed on the conductive support, and a protective layer disposed on the photosensitive layer, the method including: forming a coating film of a radical-polymerizable composition containing a perfluoropolyether compound including a radical-polymerizable functional group, a radical-polymerizable monomer including a radical-polymerizable functional group, and an inorganic fine particle including a radical-polymerizable functional group on the photosensitive layer; and radical-polymerizing the radical-polymerizable functional groups in the coating film to form the protective layer on the photosensitive layer, wherein the radical-polymerizable functional group of the perfluoropolyether compound is different from the radical-polymerizable functional group of the radical-polymerizable monomer and identical to the radical-polymerizable functional group of the inorganic fine particle. The production method can provide a photoconductor excellent in abrasion resistance, scratch resistance, and toner releasability, and generation of image defects due to cleaning failure can be prevented over a long period of time.

EXAMPLES

1. Preparation of Materials (1) Preparation of Radical-Polymerizable PFPE

Among the above-described compounds, the compounds listed in Tables 1 and 2 were prepared as the radical-polymerizable PFPE.

(2) Preparation of Radical-Polymerizable Monomer

Among the above-described monomers, the compounds listed in Tables 1 and 2 were prepared as the radical-polymerizable monomer.

(3) Production of Radical-Polymerizable Inorganic Fine Particle

A. Production of Radical-Polymerizable Inorganic Fine Particle 1

The components listed below in the quantities listed below were mixed together, and put into a wet sand mill together with alumina beads with a diameter of 0.5 mm, and the resultant was mixed at 30° C. for 6 hours. Thereafter, methyl ethyl ketone and the alumina beads were separated through filtration, and the residual product was dried at 60° C., and thus radical-polymerizable inorganic fine particle 1 was produced. The number average primary particle size of tin oxide ($SnO_2$) was 20 nm. KBM-503 (Shin-Etsu Chemical Co., Ltd.) was used as 3-methacryloxypropyltrimethoxysilane.

Tin oxide (metal oxide fine particle): 100 parts by weight 3-methacryloxypropyltrimethoxysilane (surface treating agent): 10 parts by weight Methyl ethyl ketone: 1,000 parts by weight B. Production of Radical-Polymerizable Inorganic Fine Particle 2

Radical-polymerizable inorganic fine particle 2 was obtained in the same manner as for radical-polymerizable inorganic fine particle 1 except that KBM-503 was changed to KBM-5103 (Shin-Etsu Chemical Co., Ltd.). Radical-polymerizable inorganic fine particle 2 was a radical-polymerizable inorganic fine particle obtained by changing the reactive functional group of radical-polymerizable inorganic fine particle 1 (methacryloyl group) to an acryloyl group.

C. Production of Radical-Polymerizable Inorganic Fine Particle 3

Radical-polymerizable inorganic fine particle 3 was obtained in the same manner as for radical-polymerizable inorganic fine particle 1 except that tin oxide ($SnO_2$) was changed to $CuAlO_2$. The number average primary particle size of $CuAlO_2$ was 20 nm.

D. Production of Radical-Polymerizable Inorganic Fine Particle 4

Radical-polymerizable inorganic fine particle 4 was obtained in the same manner as for radical-polymerizable inorganic fine particle 1 except that tin oxide ($SnO_2$) was changed to titanium oxide ($TiO_2$). The number average primary particle size of titanium oxide was 20 nm.

E. Production of Radical-Polymerizable Inorganic Fine Particle 5

Radical-polymerizable inorganic fine particle 5 was obtained in the same manner as for radical-polymerizable inorganic fine particle 1 except that tin oxide ($SnO_2$) was changed to zinc oxide (ZnO). The number average primary particle size of zinc oxide was 20 nm.

F. Production of Radical-Polymerizable Inorganic Fine Particle 6

Radical-polymerizable inorganic fine particle 6 was obtained in the same manner as for radical-polymerizable inorganic fine particle 1 except that tin oxide ($SnO_2$) was changed to $SrCu_2O_2$. The number average primary particle size of $SrCu_2O_2$ was 20 nm.

G. Production of Radical-Polymerizable Inorganic Fine Particle 7

Radical-polymerizable inorganic fine particle 7 was obtained in the same manner as for radical-polymerizable inorganic fine particle 1 except that AD1700 was used in addition to KBM-503. The number average primary particle size of tin oxide was 20 nm. The quantities of KBM-503 and AD1700 used were identical.

2. Production of Photoconductor (1) Production of Photoconductor 1

A. Preparation of Conductive Support

The surface of a cylindrical aluminum support was cut to prepare a conductive support.

B. Formation of Intermediate Layer

The components listed below in the quantities listed below were mixed together to prepare a composition for an intermediate layer, and the composition was dispersed by using a sand mill as a disperser in a batch mode for 10 hours to prepare a coating solution. The coating solution was applied onto the conductive support by using a dip coating method at 110° C. so that the film thickness after 20 minutes of drying reached 2 μm. X1010 (Daicel-Degussa Ltd.) was used as a polyamide resin, and SMT500SAS (TAYCA CORPORATION) was used as titanium oxide.

Polyamide resin: 10 parts by weight

Titanium oxide: 11 parts by weight

Ethanol: 200 parts by weight

C. Formation of Charge Generation Layer

The components listed below in the quantities listed below were mixed together to prepare a composition for a charge generation layer, and the composition was dispersed by using a circulating ultrasonic homogenizer (RUS-600TCVP, NISSEI Corporation) at 19.5 kHz and 600 W with a circulation flow rate of 40 L/H over 0.5 hours to prepare a coating solution for a charge generation layer. The coating solution for a charge generation layer was applied onto the intermediate layer by using a dip coating method to form a charge generation layer having a dry film thickness of 0.3 μm. The charge generation material was a mixed crystal of a 1:1 adduct of titanyl phthalocyanine and (2R, 3R)-2,3-butanediol, the adduct having clear peaks at 8.3°, 24.7°, 25.1°, and 26.5° in spectral measurement of characteristic X-ray diffraction with Cu-Kα radiation, and non-adducted titanyl phthalocyanine. S-LEC BL-1 (SEKISUI CHEMICAL CO., LTD.) was used as a polyvinyl butyral resin.

Charge generation material: 24 parts by weight

Polyvinyl butyral resin: 12 parts by weight 3-methyl-2-butanone/cyclohexanone=4/1 (V/V): 400 parts by weight D. Formation of Charge Transport Layer The components listed below in the quantities listed below were mixed and dissolved together to prepare a coating solution for a charge transport layer, and the coating solution was applied onto the charge generation layer by using a dip coating method, and dried at 120° C. for 70 minutes to form a charge transport layer having a dry film thickness of 24 μm. Z300 (MITSUBISHI GAS CHEMICAL COMPANY, INC.) was used as a polycarbonate resin, and Irganox (R) 1010 (BASF Japan Ltd.) was used as an antioxidant.

Charge transport material: 60 parts by weight

Polycarbonate resin: 100 parts by weight

Antioxidant: 4 parts by weight

E. Formation of Protective Layer

The components listed below in the quantities listed below were dissolved and dispersed together to prepare a radical-polymerizable composition, and the composition was applied onto the protective layer by using a circular slide hopper applicator. After application, the composition was irradiated with ultraviolet rays by using a metal halide lamp for 1 minute to form a protective layer having a dry film thickness of 3.5 μm, and thus photoconductor 1 was produced. M2 was used as the radical-polymerizable monomer, PFPE6M was used as the radical-polymerizable PFPE, and radical-polymerizable inorganic fine particle 1 was used as the radical-polymerizable inorganic fine particle. IRGACURE (R) 819 (BASF Japan Ltd.) was used as the polymerization initiator.

Radical-polymerizable monomer: 120 parts by weight

Radical-polymerizable PFPE: 30 parts by weight

Radical-polymerizable inorganic fine particle: 100 parts by weight

Polymerization initiator: 10 parts by weight 2-butanol: 400 parts by weight (2) Production of Photoconductor 2

Photoconductor 2 was produced in the same manner as for photoconductor 1 except that the radical-polymerizable monomer was changed from M2 to M1, the radical-polymerizable PFPE was changed from PFPE6M to PFPE6A, and the radical-polymerizable inorganic fine particle was changed from radical-polymerizable inorganic fine particle 1 to radical-polymerizable inorganic fine particle 2.

(3) Production of Photoconductors 3 to 5

Photoconductors 3 to 5 were produced in the same manner as for photoconductor 1 except that the radical-polymerizable monomer was changed from M2 to M11, M5, and M14, respectively.

(4) Production of Photoconductors 6 to 9

Photoconductors 6, 7, 8, and 9 were produced in the same manner as for photoconductor 1 except that the radical-polymerizable monomer was changed from M2 to M11, and the radical-polymerizable PFPE was changed from PFPE6M to PFPE2M, PFPE3M, PFPE4M, and PFPE6M, respectively.

(5) Production of Photoconductors 10 to 14

Photoconductors 10, 11, 12, 13, and 14 were produced in the same manner as for photoconductor 1 except that the radical-polymerizable monomer was changed from M2 to M11, and the radical-polymerizable inorganic fine particle was changed from radical-polymerizable inorganic fine particle 1 to radical-polymerizable inorganic fine particles 3, 4, 5, 6, and 7, respectively.

(6) Production of Photoconductor 15

Photoconductor 15 was produced in the same manner as for photoconductor 1 except that the radical-polymerizable monomer was changed from M2 to M11, and the radical-polymerizable PFPE was changed from PFPE6M to PFPE9M.

(7) Production of Photoconductor 16

Photoconductor 16 was produced in the same manner as for photoconductor 1 except that the radical-polymerizable monomer was changed from M2 to M1.

(8) Production of Photoconductor 17

Photoconductor 17 was produced in the same manner as for photoconductor 1 except that the radical-polymerizable monomer was changed from M2 to M1, and the radical-polymerizable PFPE was changed from PFPE6M to PFPE6A.

(9) Production of Photoconductor 18

Photoconductor 18 was produced in the same manner as for photoconductor 1 except that the radical-polymerizable PFPE was changed from PFPE6M to PFPE6A.

(10) Production of Photoconductor 19

Photoconductor 19 was produced in the same manner as for photoconductor 1 except that the radical-polymerizable monomer was changed from M2 to M1, and the radical-polymerizable inorganic fine particle was changed from radical-polymerizable inorganic fine particle 1 to radical-polymerizable inorganic fine particle 2.

(11) Production of Photoconductor 20

Photoconductor 20 was produced in the same manner as for photoconductor 1 except that the radical-polymerizable inorganic fine particle was changed from radical-polymerizable inorganic fine particle 1 to radical-polymerizable inorganic fine particle 2.

(12) Production of Photoconductor 21

Photoconductor 21 was produced in the same manner as for photoconductor 1 except that the radical-polymerizable PFPE was changed from PFPE6M to PFPE6A, and the radical-polymerizable inorganic fine particle was changed from radical-polymerizable inorganic fine particle 1 to radical-polymerizable inorganic fine particle 2.

(13) Production of Photoconductor 22

Photoconductor 22 was produced in the same manner as for photoconductor 1 except that the radical-polymerizable monomer was changed from M2 to M11, and the radical-polymerizable inorganic fine particle was changed from radical-polymerizable inorganic fine particle 1 to a non-surface-treated metal oxide particle ($SnO_2$).

(14) Production of Photoconductor 23

Photoconductor 23 was produced in the same manner as for photoconductor 1 except that the radical-polymerizable monomer was changed from M2 to M11, and no radical-polymerizable inorganic fine particle was added.

(15) Production of Photoconductor 24

Photoconductor 24 was produced in the same manner as for photoconductor 1 except that the radical-polymerizable monomer was changed from M2 to M1, the radical-polymerizable PFPE was changed from PFPE6M to PFPE6A, and no radical-polymerizable inorganic fine particle was added.

(16) Production of Photoconductor 25

Photoconductor 25 was produced in the same manner as for photoconductor 1 except that the radical-polymerizable monomer was changed from M2 to M11, and the radical-polymerizable inorganic fine particle was changed from radical-polymerizable inorganic fine particle 1 to a hydrophobized inorganic fine particle.

Tables 1 and 2 show the radical-polymerizable monomers, radical-polymerizable PFPEs, and radical-polymerizable inorganic fine particles used for production of photoconductors 1 to 25.

TABLE 1

| | | Radical-polymerizable monomer | | Radical-polymerizable PFPE | | Radical-polymerizable inorganic fine particle | | | |
|---|---|---|---|---|---|---|---|---|---|
| Classification | Photoconductor No. | Compound example | Polymerizable functional group | Compound example | Polymerizable functional group | Radical-polymerizable inorganic fine particle No. | Oxide | Surface treating agent | Polymerizable functional group |
| Example | 1 | M2 | acryloyl | PFPE6M | methacryloyl | 1 | $SnO_2$ | KBM-503 | methacryloyl |
| | 2 | M1 | methacryloyl | PFPE6A | acryloyl | 2 | $SnO_2$ | KBM-5103 | acryloyl |
| | 3 | M11 | acryloyl | PFPE6M | methacryloyl | 1 | $SnO_2$ | KBM-503 | methacryloyl |
| | 4 | M5 | acryloyl | PFPE6M | methacryloyl | 1 | $SnO_2$ | KBM-503 | methacryloyl |
| | 5 | M14 | acryloyl | PFPE6M | methacryloyl | 1 | $SnO_2$ | KBM-503 | methacryloyl |
| | 6 | M11 | acryloyl | PFPE2M | methacryloyl | 1 | $SnO_2$ | KBM-503 | methacryloyl |
| | 7 | M11 | acryloyl | PFPE3M | methacryloyl | 1 | $SnO_2$ | KBM-503 | methacryloyl |
| | 8 | M11 | acryloyl | PFPE4M | methacryloyl | 1 | $SnO_2$ | KBM-503 | methacryloyl |
| | 9 | M11 | acryloyl | PFPE5M | methacryloyl | 1 | $SnO_2$ | KBM-503 | methacryloyl |
| | 10 | M11 | acryloyl | PFPE6M | methacryloyl | 3 | $CuAlO_2$ | KBM-503 | methacryloyl |
| | 11 | M11 | acryloyl | PFPE6M | methacryloyl | 4 | $TiO_2$ | KBM-503 | methacryloyl |
| | 12 | M11 | acryloyl | PFPE6M | methacryloyl | 5 | ZnO | KBM-503 | methacryloyl |
| | 13 | M11 | acryloyl | PFPE6M | methacryloyl | 6 | $SrCu_2O_2$ | KBM-503 | methacryloyl |
| | 14 | M11 | acryloyl | PFPE6M | methacryloyl | 7 | $SnO_2$ | KBM-503 | methacryloyl |
| | | | | | | | | AD1700 | — |
| | 15 | M11 | acryloyl | PFPE9M | methacryloyl | 1 | $SnO_2$ | KBM-503 | methacryloyl |

TABLE 2

| Classification | Photo-conductor No. | Radical-polymerizable monomer: Compound example | Radical-polymerizable monomer: Polymerizable functional group | Radical-polymerizable PFPE: Compound example | Radical-polymerizable PFPE: Polymerizable functional group | Radical-polymerizable inorganic fine particle: Radical-polymerizable inorganic fine particle No. | Radical-polymerizable inorganic fine particle: Surface treating agent: Oxide | Surface treating agent | Surface treating agent: Polymerizable functional group |
|---|---|---|---|---|---|---|---|---|---|
| Comparative Example | 16 | M1 | methacryloyl | PFPE6M | methacryloyl | 1 | $SnO_2$ | KBM-503 | methacryloyl |
| | 17 | M1 | methacryloyl | PFPE6A | acryloyl | 1 | $SnO_2$ | KBM-503 | methacryloyl |
| | 18 | M2 | acryloyl | PFPE6A | acryloyl | 1 | $SnO_2$ | KBM-503 | methacryloyl |
| | 19 | M1 | methacryloyl | PFPE6M | methacryloyl | 2 | $SnO_2$ | KBM-5103 | acryloyl |
| | 20 | M2 | acryloyl | PFPE6M | methacryloyl | 2 | $SnO_2$ | KBM-5103 | acryloyl |
| | 21 | M2 | acryloyl | PFPE6A | acryloyl | 2 | $SnO_2$ | KBM-5103 | acryloyl |
| | 22 | M11 | acryloyl | PFPE6M | methacryloyl | — | $SnO_2$ | (non-surface-treated) | |
| | 23 | M11 | acryloyl | PFPE6M | methacryloyl | — | | | |
| | 24 | M1 | methacryloyl | PFPE6A | acryloyl | — | | | |
| | 25 | M11 | acryloyl | PFPE6M | methacryloyl | — | $SnO_2$ | (without any reactive functional group) | |

3. Evaluation

Photoconductors 1 to 25 produced were subjected to an endurance test as shown in the following, and evaluated with respect to various evaluation items.

(1) Endurance Test

A full color copier having a printing rate of 100 sheets/min was prepared by customizing a full color copier (bizhub (R) PRO C1070, Konica Minolta, Inc.). Each of photoconductors 1 to 25 was installed in the full color copier, and a character image having an image ratio of 6% was continuously printed on 1,000,000 sheets in A4 long edge feeding at 30° C./85% (HH environment).

(2) Evaluation of Abrasion Resistance

Abrasion resistance was evaluated with the amount of abrasion for the film thickness of the surface of each photoconductor after the endurance test. The film thickness was measured for randomly selected 10 portions with a homogeneous thickness (except areas at least within 3 cm from each edge, because the thickness of each edge of a photoconductor tends to be heterogeneous) in each photoconductor, and the average value was used as the film thickness of the photoconductor. Measurement of the film thickness was performed by using an eddy current-type film thickness meter (EDDY560C, HELMUT FISCHER GmbH & Co.).

The difference in the thickness of the layer before and after the endurance test was defined as the amount of abrasion. A smaller amount of abrasion indicates higher abrasion resistance, and an amount of abrasion of 2.5 μm or smaller is acceptable for practical use.

(3) Evaluation of Scratch Resistance

After the endurance test, a half-tone image was output on the whole surface of an A3 paper sheet, and the scratch resistance was evaluated in accordance with the following criteria.

A: Generation of a remarkable scratch visually observable was not found in the surface of the photoconductor, and in addition the occurrence of image failure corresponding to a scratch on the photoconductor was not found in the half-tone image (satisfactory).

B: Although generation of a slight scratch was found in the surface of the photoconductor in visual observation, the occurrence of image failure corresponding to the scratch on the photoconductor was not found in the half-tone image (acceptable for practical use).

C: Generation of a clear scratch was found in the surface of the photoconductor in visual observation, and the occurrence of image failure corresponding to the scratch was also found in the half-tone image (unacceptable for practical use).

(4) Evaluation of Transfer Rate

For the evaluation, the surface of each photoconductor was subjected to visual observation and the transfer rate was determined by using the equation below during the endurance test (initial stage) and after the endurance test. For the visual observation of the surface of each photoconductor, a solid image (20 mm×50 mm) with an image density of 1.30 was formed.

Transfer rate (%)=(mass of toner transferred onto toner receiving article/mass of toner developed on photoconductor)×100

A: The transfer rate was 95% or higher during the endurance test and after the endurance test (acceptable level).

B: The transfer rate was 90% or higher during the endurance test and after the endurance test (acceptable level).

C: The transfer rate was 90% or higher and 95% or lower during the endurance test and after the endurance test (acceptable level).

D: Although the transfer rate was 90% or higher during the endurance test and after the endurance test, the occurrence of apparent image failure such as streaks, fogging, and black spots was found on the surface of the output image (unacceptable for practical use).

E: The transfer rate was lower than 90% during the endurance test or after the endurance test (unacceptable for practical use).

(5) Evaluation of Dynamic Friction Coefficient

Each photoconductor was processed into a sheet-like shape, and the dynamic friction coefficient (μ) of the surface of the photoconductor to a cleaning blade was measured by using a surface tester (HEIDON-14, Shinto Scientific Co., Ltd.). Specifically, the blade was pressed onto the photoconductor at a constant load (g), and the force (g) applied while the blade was moving in parallel with the surface of the photoconductor was measured. The dynamic friction coefficient can be determined by calculating [force applied to photoconductor (g)]/[load applied to blade (g)] while the cleaning blade was moving. The cleaning blade to be used for measurement is one to be incorporated in an image forming apparatus, and may be a urethane blade (rubber hardness: 67, Hokushin Industry Inc.), for example. In the measurement, a urethane blade was cut into a size of 5 mm×30 mm×2 mm, and a load of 25 g was applied thereto in the trail direction at an angle of 30°. The dynamic friction coefficient μ is acceptable if it is 1.0 or lower, and it is preferably 0.1 to 0.7. The amount of change between the dynamic friction coefficient μ during the endurance test and that after the endurance test is acceptable if it is 0.2 or smaller.

Table 3 shows the abrasion resistance, scratch resistance, transfer efficiency, and dynamic friction coefficient μ for photoconductors 1 to 25.

TABLE 3

| Classification | Photo-conductor No. | Internal state of protective layer | Abrasion resistance: Amount of abrasion (μm) | Scratch resistance | Transfer efficiency | Dynamic friction coefficient μ: Initial stage | After endurance | Difference |
|---|---|---|---|---|---|---|---|---|
| Example | 1 | state C | 0.9 | A | A | 0.40 | 0.46 | 0.06 |
| | 2 | state C | 1.9 | B | A | 0.42 | 0.40 | −0.02 |
| | 3 | state C | 0.7 | A | A | 0.43 | 0.46 | 0.03 |
| | 4 | state C | 0.8 | A | A | 0.42 | 0.48 | 0.06 |
| | 5 | state C | 0.8 | A | A | 0.41 | 0.47 | 0.06 |
| | 6 | state C | 0.7 | A | B | 0.41 | 0.49 | 0.08 |
| | 7 | state C | 0.6 | A | B | 0.43 | 0.50 | 0.07 |
| | 8 | state C | 0.7 | A | A | 0.44 | 0.51 | 0.07 |
| | 9 | state C | 0.6 | A | A | 0.41 | 0.42 | 0.01 |
| | 10 | state C | 0.9 | A | A | 0.40 | 0.49 | 0.09 |
| | 11 | state C | 0.9 | A | A | 0.45 | 0.52 | 0.07 |
| | 12 | state C | 1.0 | A | B | 0.42 | 0.51 | 0.09 |
| | 13 | state C | 1.1 | A | B | 0.45 | 0.50 | 0.05 |
| | 14 | state C | 0.9 | A | A | 0.39 | 0.47 | 0.08 |
| | 15 | state C | 0.9 | A | A | 0.46 | 0.51 | 0.00 |
| Comparative Example | 16 | state B | 2.1 | B | C | 0.39 | 0.43 | 0.08 |
| | 17 | state B | 2.3 | B | D | 0.35 | 0.45 | 0.04 |
| | 18 | state B | 1.6 | A | D | 0.38 | 0.50 | 0.10 |
| | 19 | state B | 2.1 | B | D | 0.36 | 0.51 | 0.12 |
| | 20 | state B | 0.8 | A | D | 0.35 | 0.47 | 0.15 |
| | 21 | state B | 0.5 | A | C | 0.31 | 0.46 | 0.12 |
| | 22 | state A | 2.1 | C | E | 1.12 | 1.56 | 0.15 |
| | 23 | state A | 4.6 | C | E | 1.25 | 1.58 | 0.44 |
| | 24 | state A | 5.8 | C | E | 1.13 | 1.62 | 0.33 |
| | 25 | state A | 2.9 | C | E | 1.33 | 1.61 | 0.49 |

As shown in Table 3, photoconductors 1 to 15, in each of which the radical-polymerizable functional group of the PFPE is identical to the radical-polymerizable functional group of the inorganic fine particle and the radical-polymerizable functional group of the radical-polymerizable monomer is different from the radical-polymerizable functional group of the PFPE, were each satisfactory in any of the abrasion resistance, scratch resistance, transfer efficiency, and dynamic friction coefficient.

In contrast, photoconductors 16, 18, and 21, in each of which the first radical-polymerizable functional group is identical to the second radical-polymerizable functional group, each had poor transfer efficiency in comparison with photoconductors 1 to 15. Photoconductors 17, 19, and 20, in each of which the first radical-polymerizable functional group is different from the third radical-polymerizable functional group, had poor transfer efficiency in comparison with photoconductors 1 to 15. Further, photoconductors 22 to 25, each of which includes a metal oxide including no radical-polymerizable functional group as an inorganic fine particle, each had poor scratch resistance, poor transfer efficiency and a poor dynamic friction coefficient in comparison with photoconductors 1 to 15. Furthermore, photoconductor 23 and 24 were each poor also in abrasion resistance in comparison with photoconductors 1 to 15.

INDUSTRIAL APPLICABILITY

According to the present invention, abrasion resistance, scratch resistance, and transfer efficiency can be enhanced in a photoconductor of an electrophotographic image forming apparatus. Therefore, according to the present invention, further increase in performance, durability and widespread use in the electrophotographic image forming apparatus is expected.

Although embodiments of the present invention have been described and illustrated in detail, it is clearly understood that the same is by way of illustration and example only and not limitation, the scope of the present invention should be interpreted by terms of the appended claims.

REFERENCE SIGNS LIST

1Y, 1M, 1C, 1Bk Photoconductor
2Y, 2M, 2C, 2Bk Charging Unit
3Y, 3M, 3C, 3Bk Light Exposing Unit
4Y, 4M, 4C, 4Bk Developing Unit
5Y, 5M, 5C, 5Bk Primary Transfer Roller
5*b* Secondary Transfer Roller
6Y, 6M, 6C, 6Bk, 6*b* Cleaning Unit
7Y, 7M, 7C, 7Bk Lubricant-Feeding Unit
8Y Leveling Blade
10Y, 10M, 10C, 10Bk Image Forming Unit
20 Sheet Feeding Cassette
21 Sheet-Feeding Unit
22A, 22B, 22C, 22D Intermediate Roller
23 Registration Roller
24 Fixing Unit
25 Sheet Ejection Roller
26 Sheet Tray
30 Blade Member
31 Supporting Member
41 Brush Roller
42 Lubricant Stock
43 Pressurizing Spring
70 Intermediate Transfer Member Unit

71, 72, 73, 74 Roller
77 Intermediate Transfer Member
80 Casing
82L, 82R Support Rail
A Main Body
SC Original Image Reader
P Recording Medium
Fr Perfluoropolyether (PFPE)
Mo Monomer
Ip Inorganic Fine Particle
CTL Charge Transport Layer
PL Protective Layer
FrL Perfluoropolyether (PFPE)

What is claimed is:

1. A photoconductor comprising a conductive support, a photosensitive layer disposed on the conductive support, and a protective layer disposed on the photosensitive layer, wherein the protective layer is a polymer of a radical-polymerizable composition comprising a perfluoropolyether compound including a radical-polymerizable functional group, a radical-polymerizable monomer including a radical-polymerizable functional group, and an inorganic fine particle including a radical-polymerizable functional group, and the radical-polymerizable functional group of the perfluoropolyether compound is different from the radical-polymerizable functional group of the radical-polymerizable monomer and identical to the radical-polymerizable functional group of the inorganic fine particle.

2. The photoconductor according to claim 1, wherein the number of the radical-polymerizable functional groups of the perfluoropolyether compound is four or more.

3. The photoconductor according to claim 1, wherein each of the radical-polymerizable functional groups is an acryloyl group or a methacryloyl group.

4. The photoconductor according to claim 1, wherein the inorganic fine particle includes a metal oxide fine particle and an organic part including a radical-polymerizable functional group, the organic part being supported on the metal oxide fine particle and chemically bonding to the polymer.

5. A method for producing a photoconductor comprising a conductive support, a photosensitive layer disposed on the conductive support, and a protective layer disposed on the photosensitive layer, the method comprising:

forming a coating film of a radical-polymerizable composition comprising a perfluoropolyether compound including a radical-polymerizable functional group, a radical-polymerizable monomer including a radical-polymerizable functional group, and an inorganic fine particle including a radical-polymerizable functional group on the photosensitive layer; and radical-polymerizing the radical-polymerizable functional groups in the coating film to form the protective layer on the photosensitive layer, wherein the radical-polymerizable functional group of the perfluoropolyether compound is different from the radical-polymerizable functional group of the radical-polymerizable monomer and identical to the radical-polymerizable functional group of the inorganic fine particle.

* * * * *